US009385421B2

(12) United States Patent
Okano et al.

(10) Patent No.: US 9,385,421 B2
(45) Date of Patent: Jul. 5, 2016

(54) ANTENNA AND ELECTRONIC DEVICE FOR CLOSE PROXIMITY WIRELESS COMMUNICATION

(71) Applicant: Kabushiki Kaisha Toshiba, Minato-ku, Tokyo (JP)

(72) Inventors: Motochika Okano, Tokyo (JP); Toshiki Miyasaka, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 195 days.

(21) Appl. No.: 14/321,253

(22) Filed: Jul. 1, 2014

(65) Prior Publication Data

US 2015/0263416 A1 Sep. 17, 2015

(30) Foreign Application Priority Data

Mar. 13, 2014 (JP) ..... 2014-049679

(51) Int. Cl.

| | |
|---|---|
| ***H01Q 9/30*** | (2006.01) |
| ***H01Q 1/36*** | (2006.01) |
| ***H01Q 1/24*** | (2006.01) |
| *H01Q 9/24* | (2006.01) |

(52) U.S. Cl.

CPC . *H01Q 1/36* (2013.01); *H01Q 1/243* (2013.01)

(58) Field of Classification Search

CPC ..... H01Q 1/243; H01Q 1/36; H01Q 23/24; H01Q 9/285; H01Q 9/16; H01Q 21/20; H01Q 9/42; H04B 7/0689; H04B 5/0075; H04B 7/0602; H04W 52/0251; H05K 1/16; Y02B 60/50

USPC ..... 343/702, 729, 730, 726, 752, 802, 803, 343/804, 806, 808, 809, 843; 455/41.1, 455/41.2

See application file for complete search history.

(56) References Cited

U.S. PATENT DOCUMENTS 2,283,938 A * 5/1942 McKesson ..... H01Q 9/26 343/733
2,888,678 A * 5/1959 Weiss ..... H01Q 5/49 343/802

(Continued)

FOREIGN PATENT DOCUMENTS

JP 4908576 B2 4/2012
JP 5058356 * 10/2012

(Continued)

*Primary Examiner* — Dameon E Levi
*Assistant Examiner* — Awat Salih
(74) *Attorney, Agent, or Firm* — White & Case LLP

(57) ABSTRACT

According to one embodiment, an antenna includes first and second coupling elements and first to fourth connecting elements. An electrical length between a middle point of the first coupling element and each of both open ends thereof is a first electrical length which is an odd multiple of ¼ of a wavelength λ corresponding to a frequency used for close proximity wireless communication. An electrical length between a middle point of the second coupling element and each of both open ends thereof is the first electrical length. An electrical length of each of the first to fourth connecting elements is a second electrical length which is an odd multiple of ¼ of the wavelength λ.

11 Claims, 17 Drawing Sheets

(56) References Cited

U.S. PATENT DOCUMENTS

| | | | | | |
|---|---|---|---|---|---|
| 3,014,216 | A * | 12/1961 | Yaru | H01Q 5/15 | 343/801 |
| 4,500,887 | A * | 2/1985 | Nester | H01Q 1/38 | 343/700 MS |
| 6,346,922 | B1 * | 2/2002 | Proctor | G06K 7/10346 | 343/795 |
| 8,797,115 | B2 * | 8/2014 | Shimasaki | H04B 5/0037 | 333/24 R |
| 2010/0309068 | A1 * | 12/2010 | Duron | H01Q 1/2216 | 343/730 |
| 2011/0128189 | A1 | 6/2011 | Shimasaki | | |
| 2011/0151805 | A1 | 6/2011 | Hayashi et al. | | |
| 2012/0149314 | A1 * | 6/2012 | Shimasaki | H01Q 1/2266 | 455/90.2 |
| 2012/0274426 | A1 * | 11/2012 | Shimasaki | H04B 5/0037 | 333/24 R |

FOREIGN PATENT DOCUMENTS

| | | | |
|---|---|---|---|
| JP | 2012-231314 | A | 11/2012 |
| JP | 5284336 | B2 | 9/2013 |

* cited by examiner

ANTENNA AND ELECTRONIC DEVICE FOR CLOSE PROXIMITY WIRELESS COMMUNICATION

CROSS-REFERENCE TO RELATED APPLICATIONS

This application is based upon and claims the benefit of priority from Japanese Patent Application No. 2014-049679, filed Mar. 13, 2014, the entire contents of which are incorporated herein by reference.

FIELD

Embodiments described herein relate generally to a close proximity wireless technology.

BACKGROUND

Recently, there has been developed a close proximity wireless technology capable of performing high-speed data communication. The close proximity wireless technology realizes high-speed wireless data transfer between two devices in close proximity to each other. Each of the devices having a close proximity wireless communication function comprises a close proximity wireless antenna (coupler).

An antenna used for close proximity wireless technology is typically constituted by a coupling electrode, a resonator and a ground plane and the like. A signal is supplied to the coupling electrode via the resonator. As a result, a large charge is accumulated in the coupling electrode. This allows the antennas of the two devices brought close to each other to be coupled.

However, to perform stable data communication between devices by close proximity wireless communication, it has been conventionally necessary that the antennas of these devices face with each other with high precision.

Therefore, there is required a new technology that allows devices to be easily coupled with each other.

DETAILED DESCRIPTION

Figure 1:
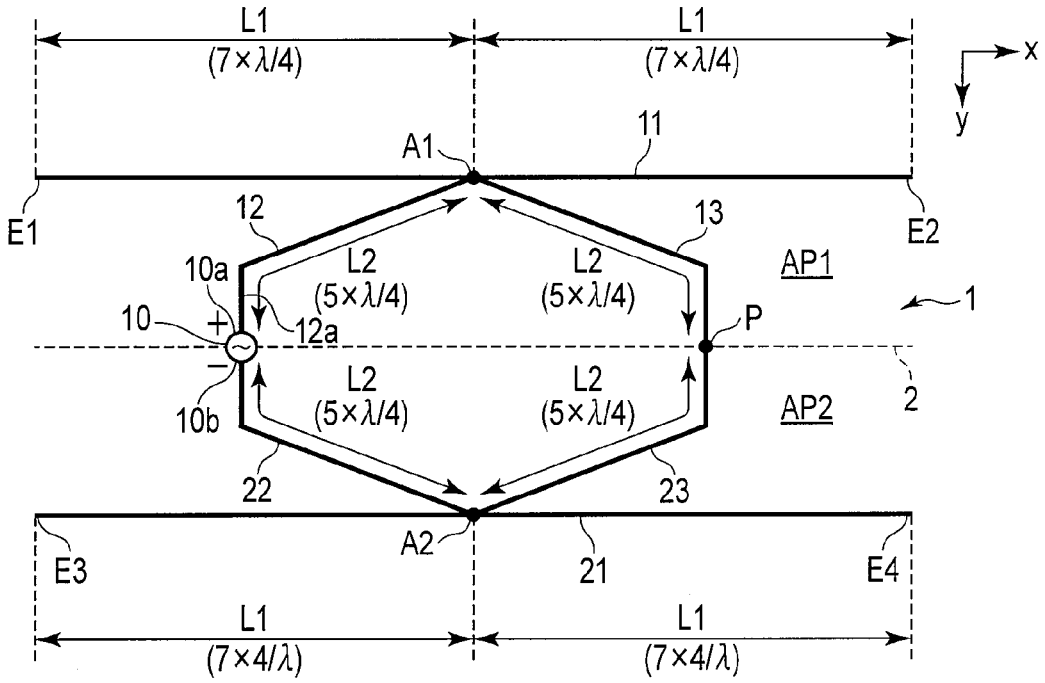
FIG. 1 is an exemplary view illustrating the structure of an antenna (coupler) according to an embodiment.

Various embodiments will be described hereinafter with reference to the accompanying drawings.

In general, according to one embodiment, an antenna comprises a first coupling element, a second coupling element, a first connecting element, a second connecting element, a third connecting element and a fourth connecting element.

The first coupling element, comprising a first open end and a second open end, extends in a first direction. The second coupling element, comprising a third open end and a fourth open end, faces the first coupling element across a gap and extends parallel to the first coupling element.

The first connecting element connects a positive-side feed point of a feed terminal and a middle point between the first open end and the second open end of the first coupling element. The feed terminal is positioned between the first coupling element and the second coupling element. The second connecting element connects a connecting point positioned between the first coupling element and the second coupling element and the middle point of the first coupling element.

The third connecting element connects a ground-side feed point of the feed terminal and a middle point between the third open end and the fourth open end of the second coupling element. The fourth connecting element connects the connecting point and the middle point of the second coupling element.

An electrical length between the middle point of the first coupling element and each of the first open end and the second open end is a first electrical length which is an odd multiple of ¼ of a wavelength λ corresponding to a frequency used for close proximity wireless communication.

An electrical length between the middle point of the second coupling element and each of the third open end and the fourth open end is the first electrical length. Each of the electrical length of the first, second, third and fourth connecting elements is a second electrical length which is an odd multiple of ¼ of the wavelength λ.

To begin with, the structure of an antenna 1 according to an embodiment will be described with reference to FIG. 1. The antenna 1 is configured to transmit and receive an electromagnetic wave by electromagnetic coupling between the antenna 1 and another antenna. The antenna 1 functions as an antenna (coupler) used for close proximity wireless communication. In close proximity wireless communication, data transfer is performed between devices brought close to each other. For a close proximity wireless communication scheme, TransferJet® can be used, for example. TransferJet® is a close proximity wireless communication scheme of using an ultra-wideband (UWB). When two devices are brought close together within the range of communication (for example, 3 cm), the antennas disposed in the devices are coupled electromagnetically. This coupling allows the devices to perform peer-to-peer wireless communication.

The antenna 1 is realized as a planar antenna so as to be easily attached to various devices. The antenna 1 can be realized by a wiring pattern on a printed circuit board.

The antenna 1 is configured to easily couple a device equipped with the antenna 1 with other device (peer device). For example, the device equipped with the antenna 1 may be a digital terminal (box) configured to provide various services for a mobile device such as smartphone. In this case, it is preferable that stable close proximity wireless communication between devices can be always performed wherever in the upper surface (communication surface) of the housing of the digital terminal (box) the mobile device is placed on, or wherever in the upper surface (communication surface) the mobile device is brought close to.

Alternatively, the device equipped with the antenna 1 may be a mobile device such as smartphone. In this case, whichever portion on the back surface of the housing of the smartphone is brought close to the antenna (coupler) portion of other devices, it is preferable that close proximity wireless communication can be stably performed between the devices.

In the embodiment, an antenna structure capable of electromagnetically coupling the antenna 1 with other antennas without facing them with each other with high precision is adopted. In such an antenna structure, not only a specific part of the upper surface of the antenna 1 having a plain shape, but the whole of the upper surface of the antenna 1 functions as a coupling portion.

The antenna structure can ease a restriction on positioning of the devices, for example, a restriction on positioning of the digital terminal (box) and the mobile device. Therefore, stable data communication between the digital terminal (box) and the mobile device can be always performed by using the close proximity wireless communication wherever in the upper surface (communication surface) of the housing of the digital terminal (box) the mobile device is placed on, or wherever in the upper surface (communication surface) the mobile device is brought close to.

In addition, the antenna structure of the embodiment provides an antenna structure suitable for making the coupling element (coupling portion) of the antenna 1 larger in size.

An antenna structure having a large-area coupling element (coupling portion) is suitable for realizing an antenna disposed on the upper surface (communication surface) of the housing of the digital terminal (box) and an antenna disposed on the back surface of the mobile device.

The structure of the antenna 1 will be described below.

FIG. 1 is a view of the antenna 1 viewed from the upper surface. As shown in FIG. 1, the antenna 1 comprises a first coupling element 11, a connecting element 12, a connecting element 13, a second coupling element 21, a connecting element 22 and a connecting element 23. Each of the elements 11 to 13 and 21 to 23 is a line-shaped element and can be realized by a wiring pattern on a printed circuit board.

A first antenna pattern AP1 comprising the first coupling element 11, the connecting element 12 and the connecting element 13 and an antenna pattern AP2 comprising the second coupling element 21, the connecting element 22 and the connecting element 23 are symmetrical with respect to a center line 2 extending in a longitudinal direction (x-direction) of the antenna 1.

The first coupling element 11 is an element used for electromagnetically coupling the antenna 1 with another antenna. The first coupling element 11 is an elongated element and has an open end E1 and an open end E2. The open end E1 is one end of the first coupling element 11, to which no electrical conductor is connected. The open end E2 is the other end of the first coupling element 11, to which no electrical conductor is connected. The first coupling element 11 extends in a first direction (x-direction).

Also, the second coupling element 21 is an element used for electromagnetically coupling the antenna 1 with another antenna. The second coupling element 21 faces the first coupling element 11 across a gap and extends parallel to the first coupling element 11.

The second coupling element 21 is an elongated element and has an open end E3 and an open end E4. The open end E3 is one end of the second coupling element 21, to which no electrical conductor is connected. The open end E4 is the other end of the second coupling element 21, to which no electrical conductor is connected.

In the antenna 1, a feed terminal 10 and a connecting point (short-circuiting point) P are positioned in a region between the first coupling element 11 and the second coupling element 21. The feed terminal 10 may be a connector, to which a coaxial cable that transfers a signal is connected. The connecting point (short-circuiting point) P is a connecting position for connecting the two antenna patterns AP1 and AP2.

The feed terminal 10 and the connecting point (short-circuiting point) P may be positioned on the center line 2. Also, the feed terminal 10 and the connecting point (short-circuiting point) P may be positioned on both sides of a virtual line that connects a middle point A1 of the first coupling element 11 with a middle point A2 of the second coupling element 21. The distance in the x-direction between the feed terminal 10 and the connecting point P is not particularly limited and should be suitable for the lengths of the connecting elements 12, 13, 22 and 23. The lengths (electrical lengths) of the connecting elements 12, 13, 22 and 23 will be described later.

The connecting element 12 is an element that connects a positive-side feed point 10*a* of the feed terminal 10 and the middle point A1 of the first coupling element 11 for feeding the first coupling element 11. One end of the coupling element 12 is connected to the positive-side feed point 10*a*. The other end of the coupling element 12 is connected to the middle point A1 of the first coupling element 11. In the following, the connecting element 12 is called a feeding element.

The middle point A1 of the first coupling element 11 is a middle point between the two open ends E1 and E2 of the first coupling element 11. That is, the middle point A1 of the first coupling element 11 is positioned in a middle point in a longitudinal direction of the first coupling element 11. The distance between the open end E1 and the middle point A1 is equal to the distance between the open end E2 and the middle point A1.

The positive-side feed point 10*a* is a positive-side terminal of the above-mentioned connector. The connector comprises a positive-side terminal connected to the internal conductor of the coaxial cable and a ground-side terminal connected to the external conductor of the coaxial cable. The positive-side terminal is used as the positive-side feed point 10*a* and the ground-side terminal is used as a ground-side feed point 10*b*.

The connecting element 13 is an element that connects the connecting point (short-circuiting point) P and the middle point A1 of the first coupling element 11. One end of the connecting element 13 is connected to the connecting point (short-circuiting point) P. The other end of the connecting element 13 is connected to the middle point A1 of the first coupling element 11. In the following, the connecting element 13 is called a short-circuiting element.

The first antenna pattern AP1 comprising the first coupling element 11, the feeding element 12, the short-circuiting element 13 is symmetrical with respect to the middle point A1 of the first coupling element 11. The connecting element 22 is an element that connects the ground-side feed point 10*b* of the feed terminal 10 and the middle point A2 of the second coupling element 21 for feeding the second coupling element 21. One end of the coupling element 22 is connected to the ground-side feed point 10*b*. The other end of the coupling element 22 is connected to the middle point A2 of the second coupling element. In the following, the connecting element 22 is called a feeding element.

The middle point A2 of the second coupling element 21 is a middle point between the two open ends E3 and E4 of the second coupling element 21. That is, the middle point A2 of the second coupling element 21 is positioned in a middle point in a longitudinal direction of the second coupling element 21. The distance between the open end E3 and the middle point A2 is equal to the distance between the open end E4 and the middle point A2.

The connecting element 23 is an element that connects the connecting point (short-circuiting point) P and the middle point A2 of the second coupling element 21. One end of the connecting element 23 is connected to the connecting point (short-circuiting point) P. The other end of the connecting element 23 is connected to the middle point A2 of the second coupling element 21. In the following, the connecting element 23 is called a short-circuiting element.

The second antenna pattern AP2 comprising the second coupling element 21, the feeding element 22, the short-circuiting element 23 is symmetrical with respect to the middle point A2 of the second coupling element 21.

Next, the electrical length of the first coupling element 11 will be described.

The electrical length between the middle point A1 of the first coupling element 11 and the open end E1 is L1 (first electrical length). L1 is set to $n\times\lambda/4$, where $\lambda$ is the wavelength corresponding to the frequency used for the above-mentioned close proximity wireless communication. In more detail, $\lambda$ is the wavelength corresponding to a center frequency within a frequency band used for close proximity wireless communication. The n is an odd number greater than or equal to 1. In other words, the electrical length between the middle point A1 of the first coupling element 11 and the first open end E1 is an odd multiple of ¼ of the wavelength $\lambda$. If the antenna 1 (for example, the first coupling element 11) is made larger in size, the n should be an odd number greater than or equal to 3.

FIG. 1 illustrates a case where L1 is set to $7\times\lambda/4$. In such a case that ½ of the entire length of the first coupling element 11 is set to $7\times\lambda/4$, the coupling between the antenna 1 and an antenna (for example, small antenna) of another device can be always established wherever in the longitudinal part of the coupling element 11 the antenna of the another device faces. Thus, the close proximity wireless communication can be performed stably.

Similarly, the electrical length between the middle point A1 of the first coupling element 11 and the open end E1 is L1, which is the same as the electrical length between the middle point A1 of the first coupling element 11 and the open end E1.

Since the electrical length between the middle point A1 of the first coupling element 11 and the open end E1 is $n\times\Delta/4$ as mentioned above, the element portion between the middle point A1 of the first coupling element 11 and the open end E1 functions as a single resonant antenna part (resonator). Similarly, since the electrical length between the middle point A1 of the first coupling element 11 and the open end E2 is $n\times\Delta/4$, the element portion between the middle point A1 of the first coupling element 11 and the open end E2 functions as another single resonant antenna part (resonator). Thus, the first coupling element 11 itself functions as a resonator.

Therefore, in the antenna 1, a large electric current corresponding to a signal in a desired frequency band can be flowed in the first coupling element 11, without disposing a purpose-specific resonant circuit such as a resonant stab in addition to the first coupling element 11. As a result, on the upper surface of the antenna 1, a portion along with a longitudinal direction of the first coupling element 11, i.e., a region surrounding the first coupling element 11 (the upper region of the upper surface of the antenna 1), functions as a coupling portion that can be coupled with other antenna. Since the feeding element 12 is connected to the middle point A1 of the first coupling element 11 as mentioned above, a current distribution in the element portion between the middle point A1 of the first coupling element 11 and the open end E1 is symmetrical with a current distribution in the element portion between the middle point A1 of the first coupling element 11 and the open end E2. Therefore, when the antenna of a peer device is brought close to either of the element portion between the middle point A1 of the first coupling element 11 and the open end E1 or the element portion between the middle point A1 of the first coupling element 11 and the open end E2, it is possible to make the electromagnetic coupling strength between the antennas equivalent.

Next, the electrical length of the second coupling element 21 will be described.

The electrical length between the middle point A2 of the second coupling element 21 and the open end E3 is equal to L1 (first electrical length) mentioned above. Similarly, the electrical length between the middle point A2 of the second coupling element 21 and the open end E4 is equal to L1 (first electrical length) mentioned above.

Since the electrical length between the middle point A2 of the second coupling element 21 and the open end E3 is $n\times\Delta/4$, the element portion between the middle point A2 of the second coupling element 21 and the open end E3 functions as a single resonant antenna part (resonator). Similarly, since the electrical length between the middle point A2 of the second coupling element 21 and the open end E4 is $n\times\lambda/4$, the element portion between the middle point A2 of the second coupling element 21 and the open end E4 functions as another single resonant antenna part (resonator). Thus, since the second coupling element 21 itself functions as a resonator, a large electric current corresponding to a signal in a desired frequency band can be flowed in the second coupling element 21.

Therefore, on the upper surface of the antenna 1, a portion along with a longitudinal direction of the second coupling element 21, i.e., a region surrounding the second coupling element 21 (the lower region of the upper surface of the antenna 1), functions as a coupling portion that can be coupled with other antenna. Since the feeding element 22 is connected to the middle point A2 of the second coupling element 21 as mentioned above, a current distribution in the element portion between the middle point A2 of the second coupling element 21 and the open end E3 is symmetrical with a current distribution in the element portion between the middle point A2 of the second coupling element 21 and the open end E4. Therefore, when the antenna of a peer device is brought close to either of the element portion between the middle point A2 of the second coupling element 21 and the open end E3 or the element portion between the middle point A2 of the second coupling element 21 and the open end E4, it is possible to make the electromagnetic coupling strength between the antennas equivalent.

Next, each of the electrical length of the feeding element 12, the short-circuiting element 13, the feeding element 22 and the short-circuiting element 23 will be described.

In the embodiment, an electrical length L2 (second electrical length) of each of the feeding element 12, the short-circuiting element 13, the feeding element 22 and the short-circuiting element 23 is set to an odd multiple of ¼ of the wavelength λ so that a region (the central region of the upper surface of the antenna 1) between a region surrounding the first coupling element 11 and a region surrounding the second coupling element 21 can be used as a coupling portion. That is, L2 is equal to m×λ/4.

The m is an odd number greater than or equal to 1. In other words, the electrical length L2 of each of the feeding element 12, the short-circuiting element 13, the feeding element 22 and the short-circuiting element 23 is an odd multiple of ¼ of the wavelength λ. If the antenna 1 is made larger in size, the m should be an odd number greater than or equal to 3.

In view of a practical size of the antenna 1, the length of each element in the antenna 1 can be set so as to satisfy the following conditions:

(1) the n is an odd number greater than or equal to 3;

(2) the m is an odd number greater than or equal to 3; and (3) the m is smaller than or equal to the n.

FIG. 1 exemplifies that L1 is set to 7×λ/4 and L2 is set to 5×λ/4.

When the electrical length L2 (second electrical length) of each of the feeding element 12, the short-circuiting element 13, the feeding element 22 and the short-circuiting element 23 is thus set to an odd multiple of ¼ of the wavelength λ, each of the feeding element 12, the short-circuiting element 13, the feeding element 22 and the short-circuiting element 23 functions as a single resonant antenna part (resonator). As a result, a large current flows in each of the feeding element 12, the short-circuiting element 13, the feeding element 22 and the short-circuiting element 23. Therefore, on the upper surface of the antenna 1, four regions along with a longitudinal direction of the feeding element 12, the short-circuiting element 13, the feeding element 22 and the short-circuiting element 23, respectively, function as coupling portion that can be coupled with other antennas. Accordingly, the region (the central region of the upper surface of the antenna 1) between the region along with a longitudinal direction of the first coupling element 11 and the region along with a longitudinal direction of the second coupling element 21 can be used as a coupling portion. In this case, a first quadrant (upper right), a second quadrant (upper left), a third quadrant (lower left) and a fourth quadrant (lower right) in this figure are covered by the short-circuiting element 13, the feeding element 12, the feeding element 22 and the short-circuiting element 23.

Each of the short-circuiting element 13, the feeding element 12, the feeding element 22 and the short-circuiting element 23 may have at least an element portion extending in a second direction (y-direction), which is orthogonal to the first direction (x-direction). This allows the antenna 1 and an antenna of a peer device to be easily coupled, even if the peer device is brought close to the upper surface of the antenna 1 in an orientation where a longitudinal direction of a coupling element of the antenna of the peer device extends in the y-direction.

For example, the feeding element 12 may have a bent shape as shown in FIG. 1. That is, the feeding element 12 has an element portion 12*a*, which extends in the −y direction from the positive-side feed point 10*a* of the feed terminal 10, as a line segment. The element portion 12*a* extends from the positive-side feed point 10*a* of the feed terminal 10 toward the first coupling element 11. The remaining element portion (remaining line segment) of the feeding element 12 excluding the element portion 12*a*, extending from the end portion of the element portion 12*a* obliquely upward to the right, connects the end portion of the element portion 12*a* and the middle point A1 of the first coupling element 11. The feeding element 12 thus comprises two element portions that differ in an extending direction. It is thereby possible to support various orientations of the coupling element of the antenna of the peer device which faces the upper surface of the antenna 1.

The position of the x-direction of the feed terminal 10 may be set to a position between the middle point A1 and the open end E1, not immediately below the middle point A1 of the first coupling element 11. For example, the position of the x-direction of the feed terminal 10 can be set to a position offset to the −x direction compared with a position immediately below the middle point A1 of the first coupling element 11. Similarly, the position of the x-direction of the connecting point (short-circuiting point) P may be set to a position between the middle point A1 and the open end E2, not immediately below the middle point A1 of the first coupling element 11. For example, the position of the x-direction of the connecting point (short-circuiting point) P can be set to a position offset to the +x direction compared with a position immediately below the middle point A1 of the first coupling element 11.

This prevents the size in a width direction (y-direction) of the antenna 1 from increasing excessively, even if the electrical length L2 of each of the feeding element 12, the short-circuiting element 13, the feeding element 22 and the short-circuiting element 23 is elongated.

In the first coupling element 11, the greater L1 is than λ/4, the more easily a signal attenuates. That is, although the spatial area capable of coupling the first coupling element 11 and other antenna is widened the greater L1 is than λ/4, the strength of the electric field around the first coupling element 11 is likely to decrease.

However, in the embodiment, the feeding element 12; the short-circuiting element 13, the feeding element 22 and the short-circuiting element 23 as well as the first coupling element 11 function as a resonator, as mentioned above. Therefore, it is possible to obtain sufficient electrical field strength by the functions of these six elements.

Next, the features of the antenna 1 of FIG. 1 will be described with reference to FIG. 2.

Figure 2:
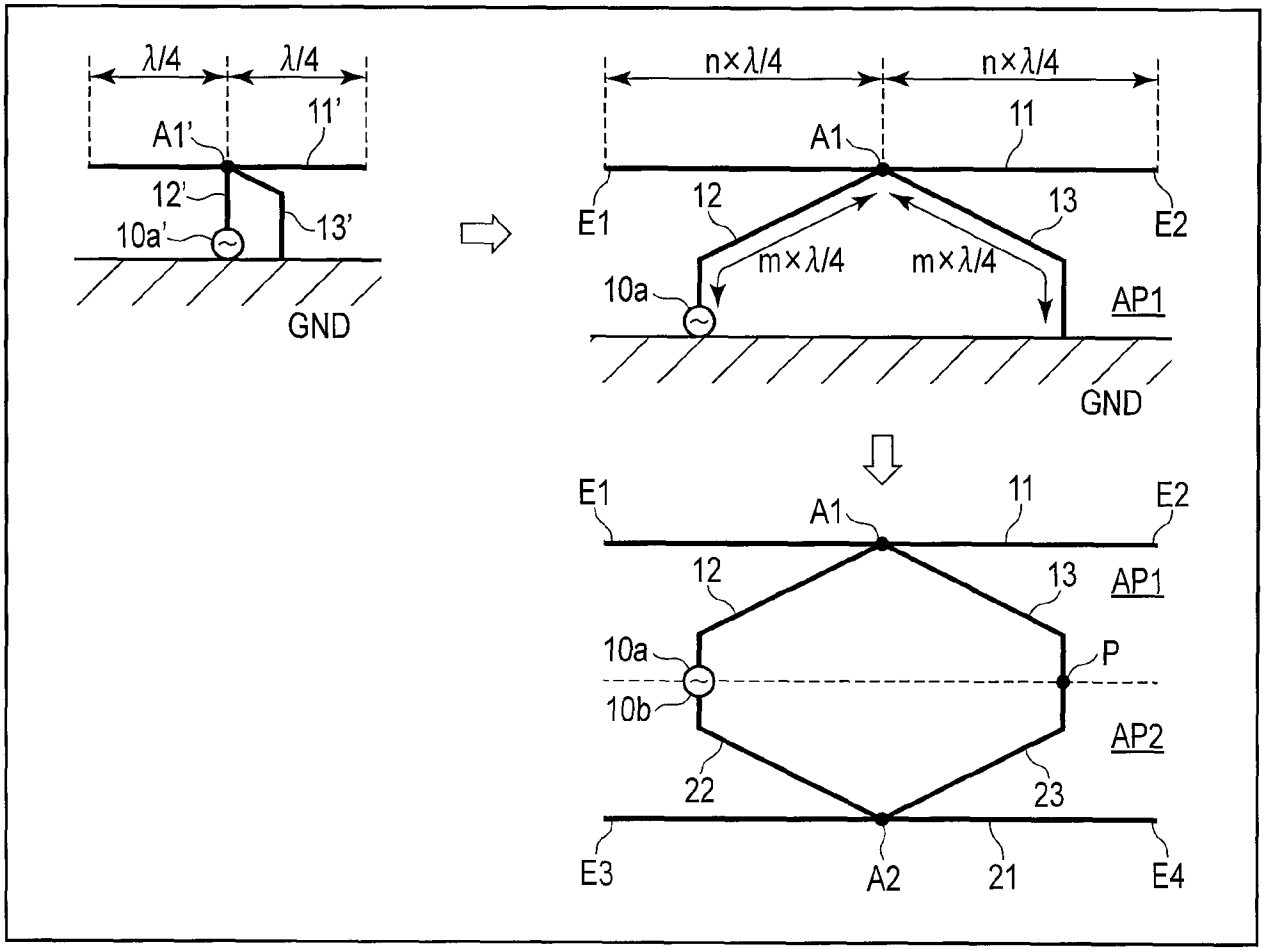
FIG. 2 is an exemplary view illustrating the features of the antenna according to the embodiment.

The upper left of FIG. 2 illustrates a plane-shape small antenna. The entire length of a coupling element 11' of the small antenna is λ/2. The length of a feeding element 12' is so short as to be ignored to the wavelength A. The feeding element 12' connects a feed point (positive-side feed point) 10*a*' and a middle point A1' of the coupling element 11'. A short-circuiting element 13' connects the middle point A1' of the coupling element 11' and a ground plane (GND).

In this small antenna, only the coupling element 11' functions as a coupling portion.

The upper right of FIG. 2 illustrates a modified antenna structure, which corresponds to a part of the antenna 1 of the embodiment.

In the modified antenna structure, the coupling element 11' is replaced with the first coupling element 11 having an entire length of 2×n×λ/4. The feeding element 12' is replaced with the feeding element 12 having a length of m×λ/4. The short-circuiting element 13' is replaced with a short-circuiting element 13 having a length of m×λ/4. Each of the feeding element 12 and the short-circuiting element 13 having a length of m×λ/4 can function as a resonator and a coupling portion. Therefore, the modified antenna structure has three coupling portions.

The lower left of FIG. 2 illustrates a further modified antenna structure, which corresponds to the structure the antenna 1 of the embodiment.

In the antenna 1, six regions corresponding to the first coupling element 11, the second coupling element 21, the feeding element 12, the short-circuiting element 13, the feeding element 22 and the short-circuiting element 23 function as a coupling portion. Therefore, a device equipped with the antenna 1 and other device can be coupled easily.

Next, the mounting structure example for realizing the antenna 1 of FIG. 1 will be described with reference to FIG. 3.

The antenna 1 comprises a printed circuit board 20. The printed circuit board 20 can be either a rigid printed circuit board or a flexible circuit board. The width of the printed circuit board 20 is W and the length of the printed circuit board 20 is L. On a first surface (front surface) 20*a* of the printed circuit board 20, the first coupling element 11, the feeding element 12, the short-circuiting element 13, the second coupling element 21, the feeding element 22, the short-circuiting element 23 and the feeding terminal (connector) 10 are disposed.

The first coupling element 11 is disposed on the first surface 20*a* so that a longitudinal direction of the first coupling element 11 extends parallel to a side 20*c* extending in a direction having the length L of the printed circuit board 20. In this case, the first coupling element 11 may be disposed on one edge portion on the first surface 20*a* extending in a direction having the length L of the printed circuit board 20 so that a long side of the first coupling element 11 is flush with the side 20*c* of the first surface 20*a* of the printed circuit board 20. The feeding element 12 extends between the middle point A1 of the first coupling element 11 and the positive-side feed point 10*a* of the feed terminal 10. The feed terminal 10 may be disposed on the back surface of the printed circuit board 20. In this case, the positive-side feed point 10*a* of the feed terminal 10 may be connected to the feeding element 12 through a via (through hole) and the ground-side feed point 10*b* of the feed terminal 10 may be connected to the feeding element 22 through a via (through hole). The short-circuiting element 13 extends between the middle point A1 of the first coupling element 11 and the connecting point (short-circuiting point) P.

The second coupling element 21 is disposed on the first surface 20*a* so that a longitudinal direction of the second coupling element 21 extends parallel to another side 20*d* extending in a direction having the length L of the printed circuit board 20. In this case, the second coupling element 21 may be disposed on the other edge portion on the first surface 20*a* extending in a direction of the length L of the printed circuit board 20 so that a long side of the second coupling element 21 is flush with the side 20*d* of the first surface 20*a* of the printed circuit board 20. The feeding element 22 extends between the ground-side feed point 10*b* of the feed terminal 10 and the middle point A2 of the second coupling element 21. The short-circuiting element 23 extends between the middle point A2 of the second coupling element 21 and the connecting point (short-circuiting point) P.

Next, another mounting structure example for realizing the antenna 1 of FIG. 1 will be described with reference to FIGS. 4 to 7.

The antenna 1 is realized by using the front and back surfaces of the printed circuit board.

Figure 4:
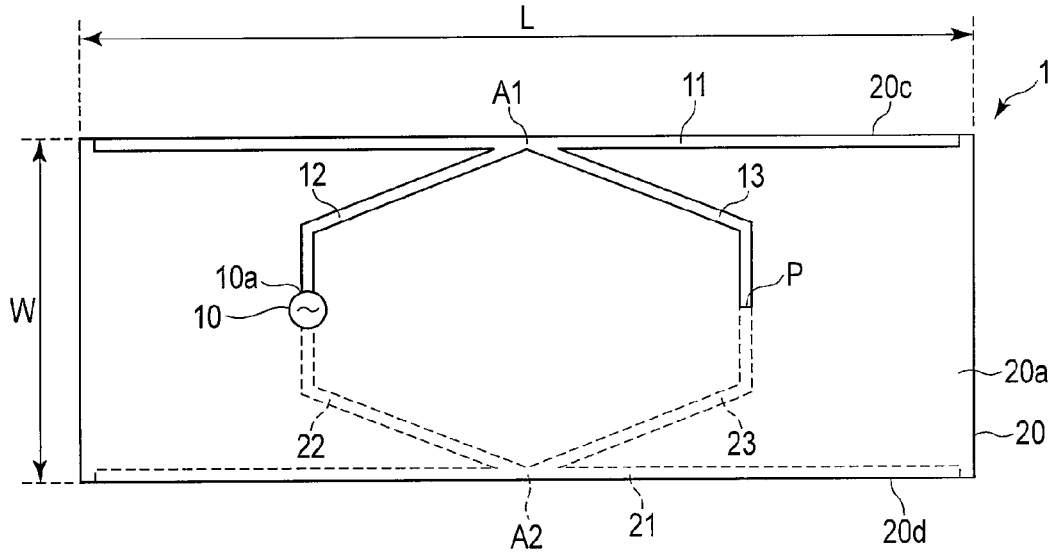
FIG. 4 is an exemplary view illustrating the second example of the mounting structure of the antenna according to the embodiment.

As shown in FIG. 4, the antenna 1 comprises the printed circuit board 20. The printed circuit board 20 can be either a rigid printed circuit board or a flexible circuit board as mentioned above. In a first region on the first surface (front surface) 20*a* of the printed circuit board 20, the first coupling element 11, the feeding element 12, the short-circuiting element 13 and the feed terminal (connector) 10 are disposed.

Figure 3:
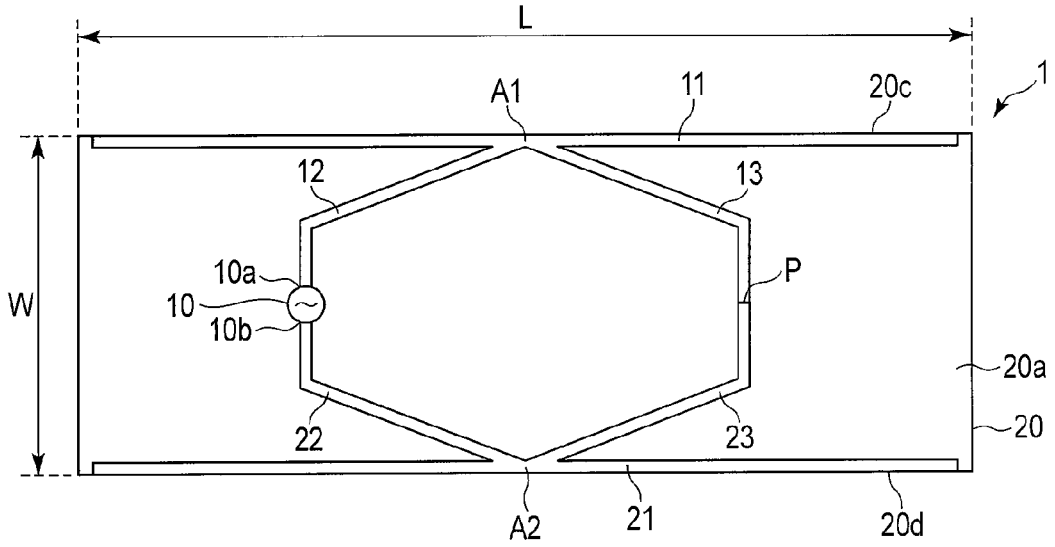
FIG. 3 is an exemplary view illustrating the first example of the mounting structure of the antenna according to the embodiment.

As with the mounting structure example described in FIG. 3, the first coupling element 11 is disposed on the first surface 20*a* so that a longitudinal direction of the first coupling element 11 extends parallel to the side 20*c* extending in a direction having the length L of the printed circuit board 20. In this case, the first coupling element 11 is disposed on the one edge portion on the first surface 20*a* extending in a direction having the length L of the printed circuit board 20 so that a long side of the first coupling element 11 is flush with the side 20*c* of the first surface 20*a* of the printed circuit board 20.

Figure 5:
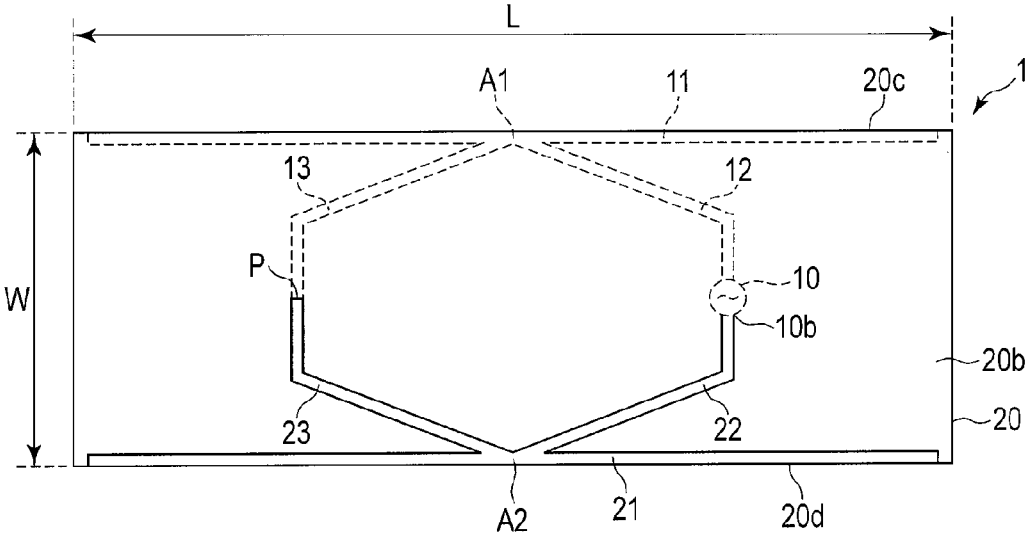
FIG. 5 is an exemplary view illustrating the mounting structure of the antenna of FIG. 4 viewed from the back side.

As shown in FIG. 5, the second coupling element 21, the feeding element 22 and the short-circuiting element 23 are disposed on a second region of the second surface 20*b* (back surface) of the printed circuit board 20. The second region on the second surface 20*b* is a region separated from the first region on the first surface 20*a* when the second region on the second surface 20*b* and the first region on the first surface 20*a* are projected onto the same plane. That is, the second region is a region that does not face the first region.

As with the mounting structure example described in FIG. 3, the second coupling element 21 is disposed on the second surface 20*b* so that a longitudinal direction of the second coupling element 21 extends parallel to the side 20*d* extending in a direction having the length L of the printed circuit board 20. In this case, the second coupling element 21 is disposed on one edge portion on the second surface 20*b* extending in a direction having the length L of the printed circuit board 20 so that a long side of the second coupling element 21 is flush with the side 20*d* of the second surface 20*b* of the printed circuit board 20.

Figure 6:
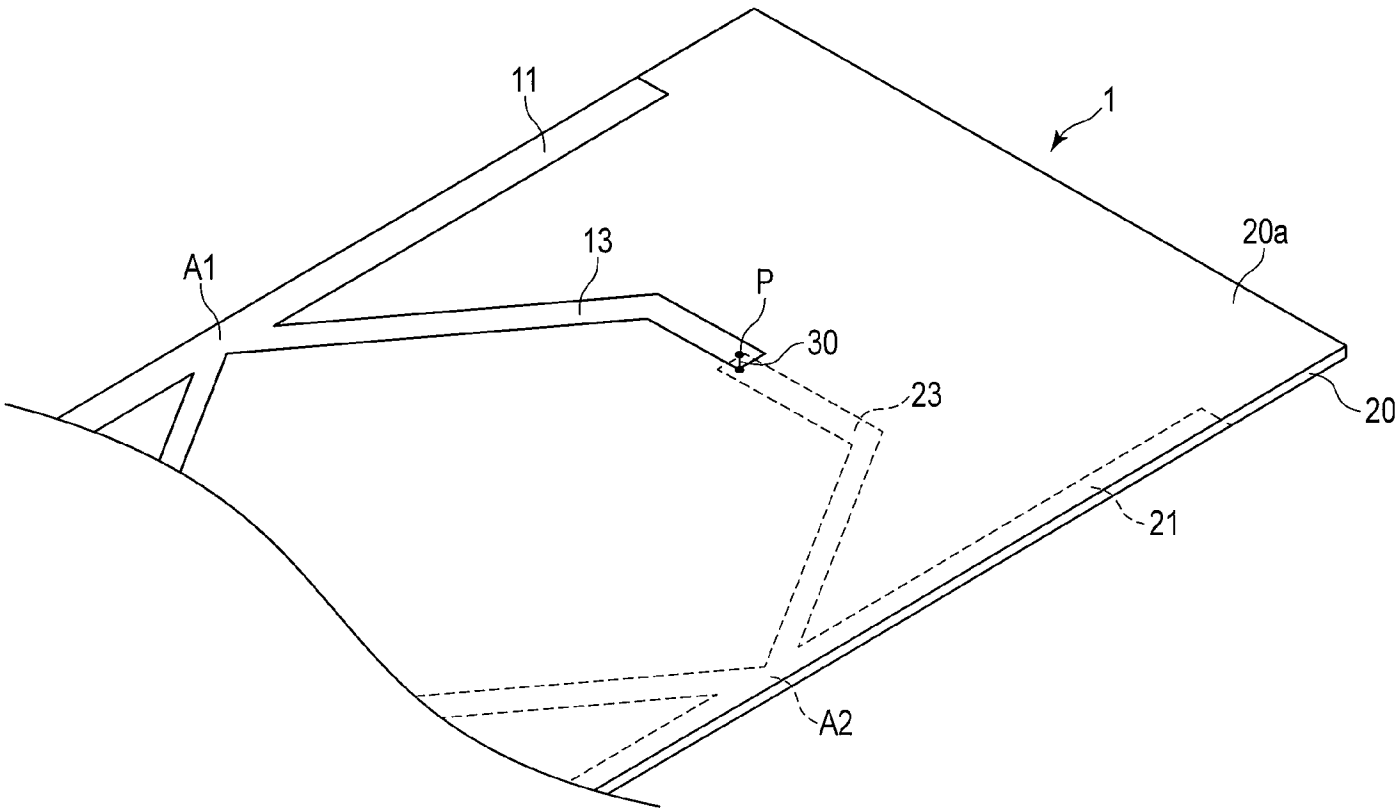
FIG. 6 is an exemplary perspective view illustrating the structure of a connecting point that connects (short-circuits) two antenna patterns in the antenna of FIG. 4.

With respect to the connecting point (short-circuiting point) P, the short-circuiting element 13 on the first surface 20*a* and the short-circuiting element 23 on the second surface 20*b* are connected with each other through a via (through-hole) 30 as shown in FIG. 6.

Figure 7:
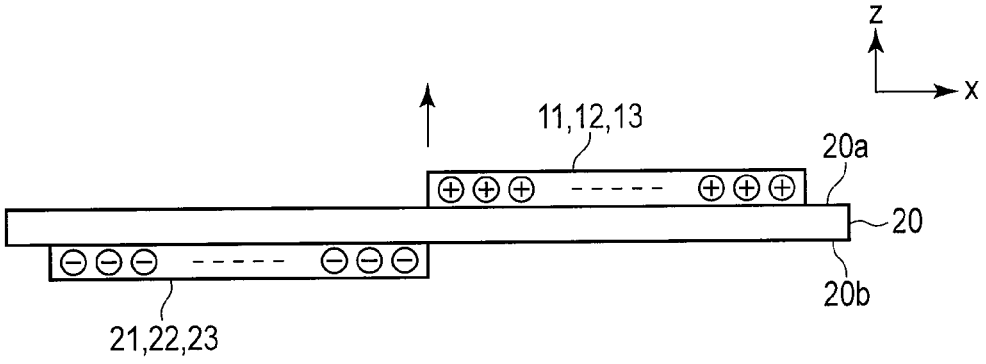
FIG. 7 is an exemplary view illustrating the direction of the electrical field of the antenna of FIG. 4.

As shown in FIG. 7, positive charge is accumulated in the first coupling element 11, the feeding element 12 and the short-circuiting element 13 in the first region on the first front surface 20*a*, while negative image charge is accumulated in the second coupling element 21, the feeding element 22 and the short-circuiting element 23 in the second region on the second surface (back surface) 20*b*. Therefore, it is possible to increase an electrical field component in a direction (z-direction) toward the upper side from the lower side of the printed circuit board 20. As a result, it is possible to improve the coupling performance in the +z direction of the planar antenna 1 and to more easily couple the planar antenna 1 with other antenna facing the upper surface of the antenna 1.

Figure 8:
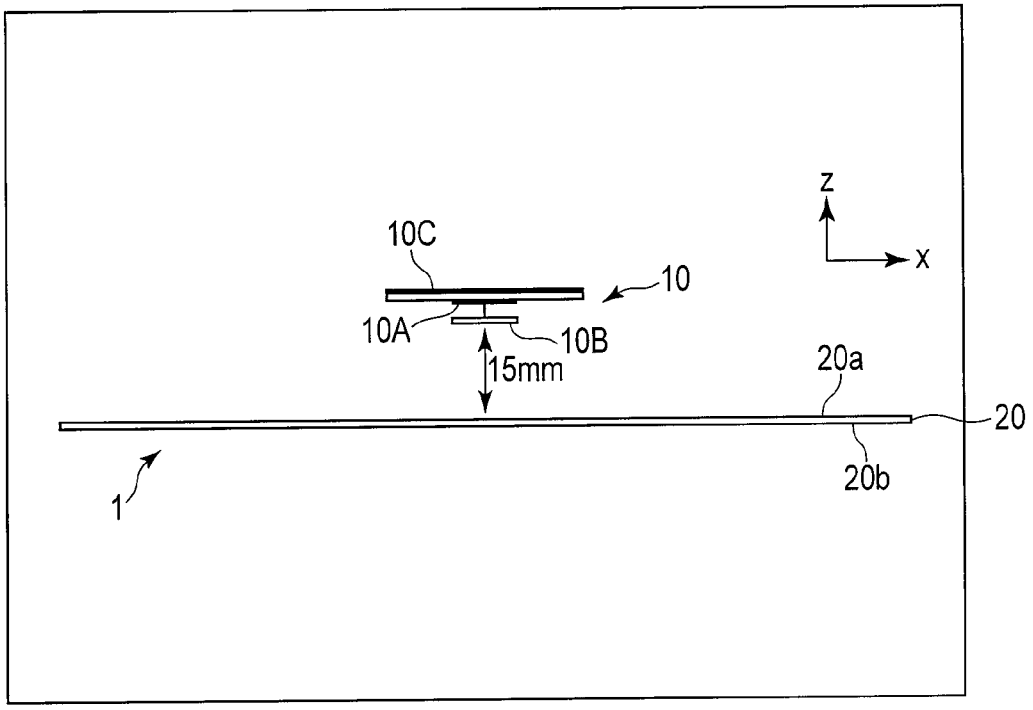
FIG. 8 is an exemplary view illustrating the positional relationship between the antenna according to the embodiment and a reference coupler used for characteristic measurement of the antenna.
Figure 9:
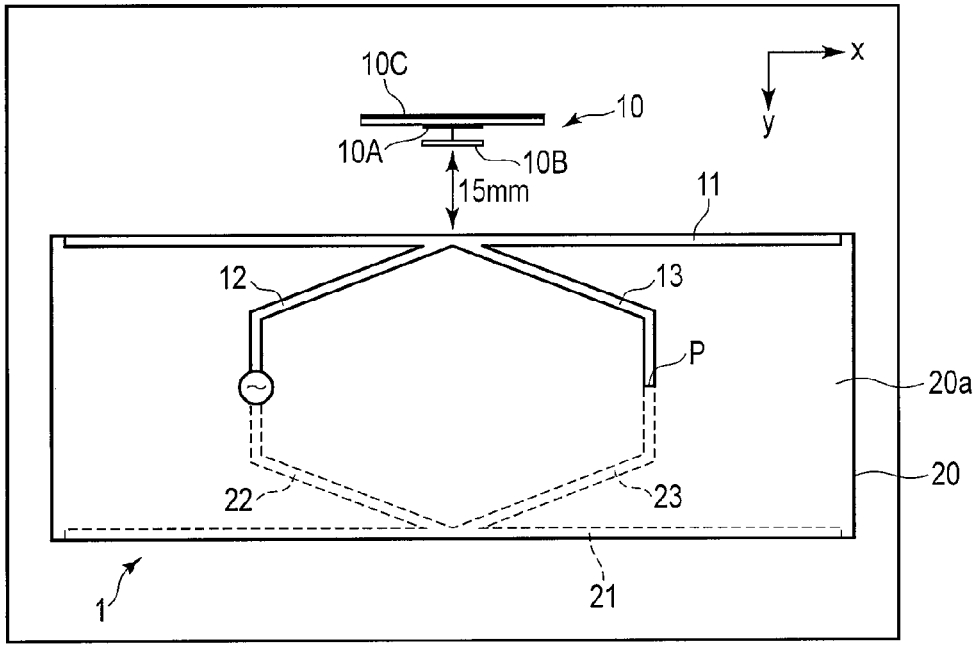
FIG. 9 is another exemplary view illustrating the positional relationship between the antenna according to the embodiment and the reference coupler used for characteristic measurement of the antenna.

Next, the result of the characteristic measurement of the antenna 1 will be described with reference to FIGS. 8 to 10. It is assumed that the antenna 1 has been implemented by using two surfaces of the printed circuit board. FIGS. 8 and 9 illustrate measurement conditions.

Under the measurement condition of FIG. 8, the antenna 1 and a reference antenna (reference coupler) 10 are separated by 15 mm in a vertical direction (z-direction). That is, the reference antenna (reference coupler) 10 is positioned separately by a distance of 15 mm from the upper surface (the first surface 20*a*) of the antenna 1.

For the reference antenna (reference coupler) 10, an antenna widely known in this field should be used. In the example of FIG. 8, the reference antenna (reference coupler) 10 comprises a resonant circuit 10A, a coupling element 10B and a ground plane 10C.

Under the measurement condition of FIG. 9, the antenna 1 and the reference antenna (reference coupler) 10 are separated by 15 mm in a horizontal direction (y-direction). That is, the reference antenna (reference coupler) 10 is positioned separately by 15 mm from the side (a side on which the first coupling element 11 is disposed) of the antenna 1.

Figure 10:
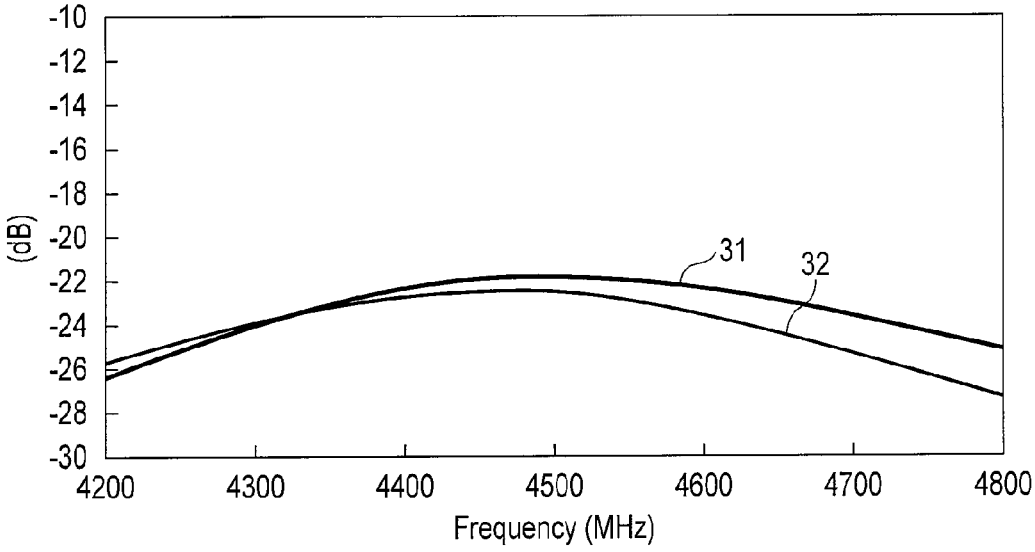
FIG. 10 is an exemplary graph illustrating the characteristics of the antenna according to the embodiment.

FIG. 10 illustrates the S21 characteristic of the antenna 1 under the measurement conditions of FIGS. 8 and 9. In FIG. 10, the horizontal axis represents a frequency and the vertical axis represents an S21 [dB].

In FIG. 10, 31 represents the S21 characteristic of the antenna 1 under the measurement condition (horizontally-faced) of FIG. 9, and 32 represents the S21 characteristic of the antenna 1 under the measurement condition (vertically-faced) of FIG. 8. In either measurement condition, a sufficient characteristic can be obtained in a frequency range close to 4.48 GHz which is the desired frequency in the close proximity wireless communication.

Figure 11:
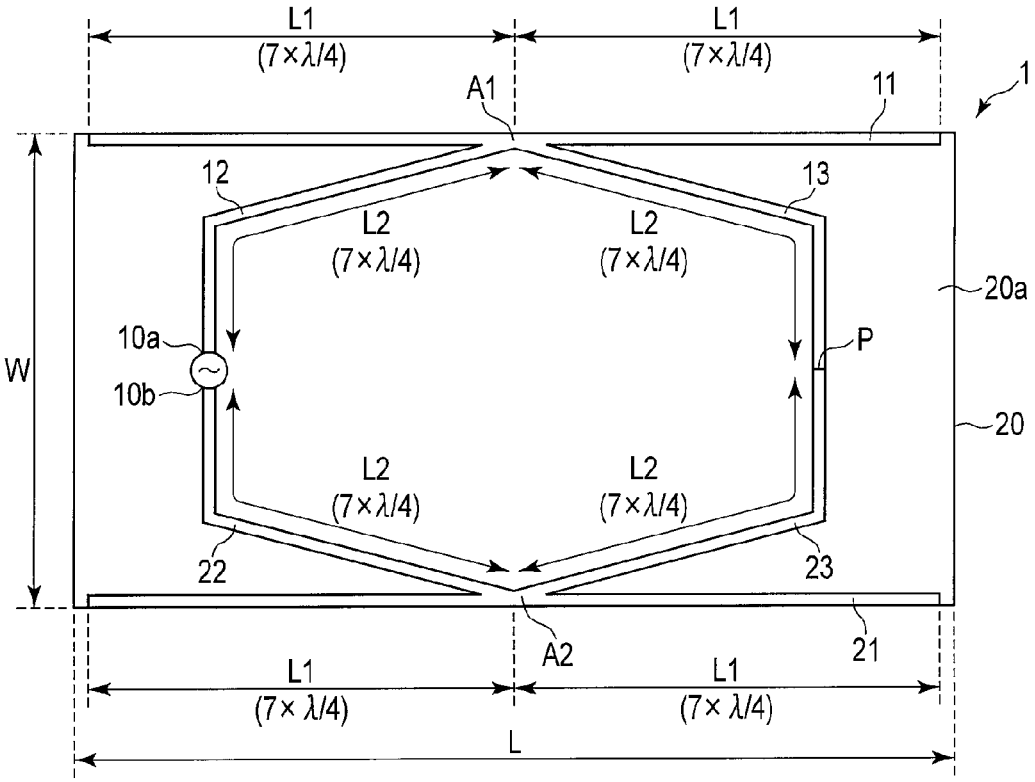
FIG. 11 is an exemplary view illustrating the antenna according to the embodiment in a case where the width of the antenna is widened.

FIG. 11 illustrates a mounting structure example where the width W of the antenna 1 is made greater than that of the antenna 1 of FIG. 3.

In FIG. 11, each of ½ of the electrical length of the first coupling element 11, the electrical length of the feeding element 12, the electrical length of the short-circuiting element 13, ½ of the electrical length of the second coupling element 21, the electrical length of the feeding element 22 and the electrical length of the short-circuiting element 23 is set to L1 ($=7\times\lambda/4$). Therefore, the width W of the antenna 1 (width W of the printed circuit board 20) is made wider than the width W of the printed circuit board 20 of FIG. 3. Note that the antenna 1 of FIG. 11 may be implemented by using both surfaces of the printed circuit board 20.

Figure 12:
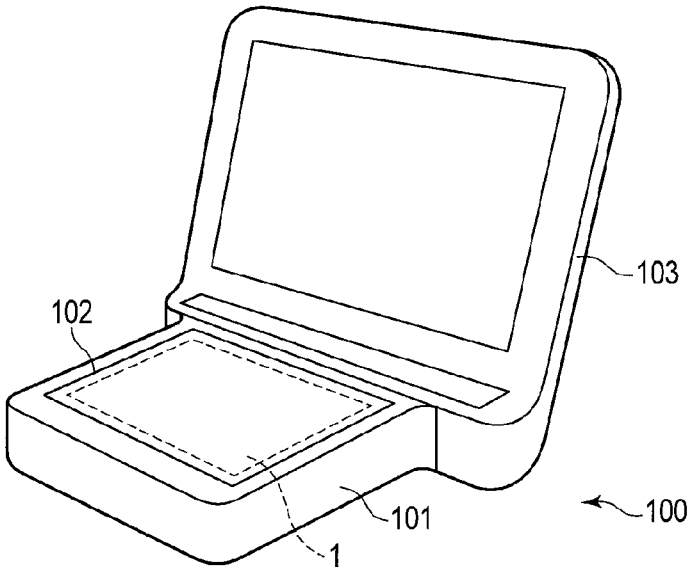
FIG. 12 is an exemplary perspective view illustrating an electronic device to which the antenna according to the embodiment is applied.

Next, the example of an electronic device equipped with the antenna 1 will be described with reference to FIG. 12.

This electronic device is a digital terminal (box) 100 configured to provide various services for a device (mobile device) such as smartphone. The box 100 comprises a box main body 101 and a display 103. The upper surface 102 of the housing of the box main body 101 functions as a communication surface configured to perform close proximity wireless communication with a smartphone. The upper surface 102 is a upper wall surface of the housing of the box main body 101.

The antenna 1 of the embodiment is disposed on the upper surface 102. In this case, the antenna 1 may be attached on the inner surface of the upper wall of the housing of the box main body 101 so that the first surface 20*a* of the printed circuit board 20 of the antenna 1 faces the inner surface of the upper wall of the housing of the box main body 101.

A user is allowed to use his or her desired service such as transfer of digital contents by placing his or her smartphone (mobile device) on or above the upper surface 102. A list of contents saved in the box main body 101 may be shown on the screen of the display 103.

Figure 13:
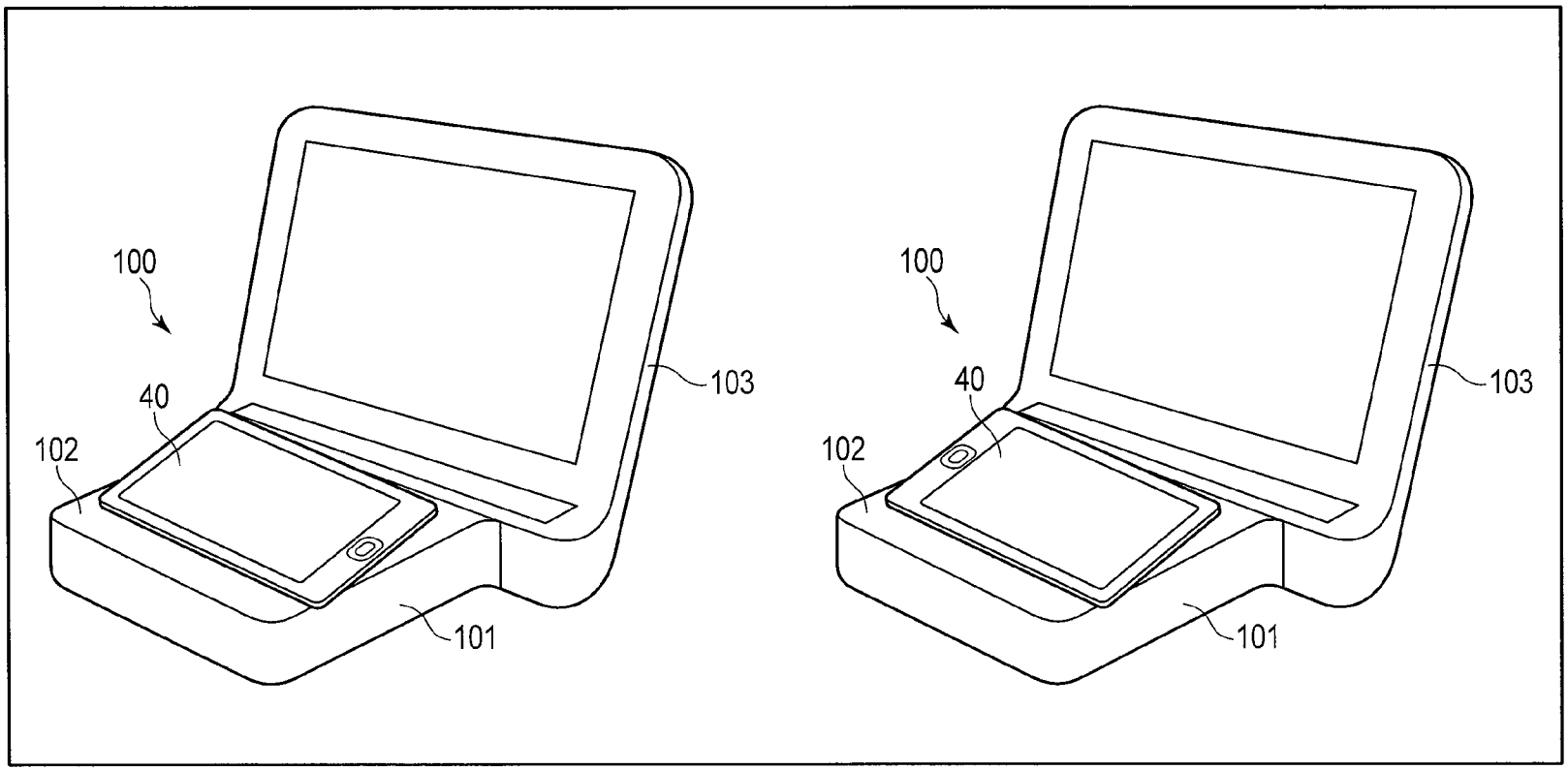
FIG. 13 is an exemplary view illustrating the orientation of an external device (smartphone) brought close to the surface of the housing of the electronic device of FIG. 12.

FIG. 13 illustrates an example of the orientation of the smartphone 40 placed on the upper surface 102. It is assumed that a small antenna (small coupler) exists on a specific position of the housing of a smartphone 40. The position on the upper surface 102, which the small antenna of the smartphone 40 faces, differs when the smartphone 40 is placed on the upper surface 102 in an orientation as shown to the left of FIG. 13 and in an orientation as shown to the right of FIG. 13. In the antenna 1 of the embodiment, almost the whole of its upper surface functions as a coupling portion. Therefore, it is possible to perform stable data communication between the smartphone 40 and the box main body 101, irrespective of the orientation of the smartphone 40 placed on the upper surface 102.

Figure 14:
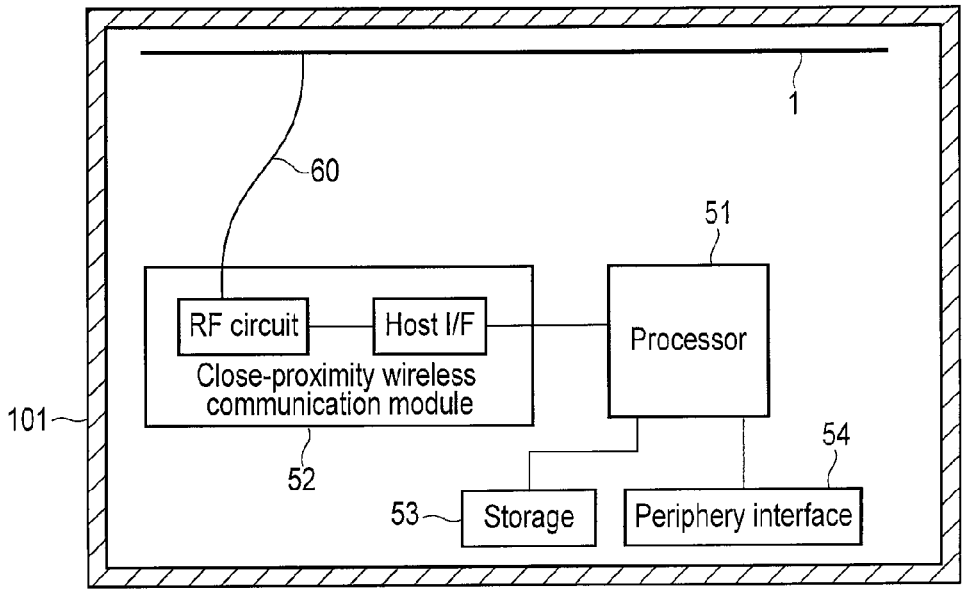
FIG. 14 is an exemplary diagram illustrating the structure of the electronic device of FIG. 12.

FIG. 14 illustrates the structure example of the box main body 101.

In the housing of the box main body 101, a processor 51, a close proximity wireless communication module 52, a storage device 53, a peripheral interface 54 and the like in addition to the antenna 1 are disposed.

The processor 51 controls the close proximity wireless communication module 52, the storage device 53 and the peripheral interface 54. The close proximity wireless communication module 52 performs close proximity wireless communication with a peer device by using the antenna 1. The close proximity wireless communication module 52 comprises a radio-frequency circuit (RF circuit) and a host interface. The host interface may be an interface such as USB. In close proximity wireless communication, a service for transferring to a peer device the contents stored in the storage device 53, a service for saving in the storage device 53 the contents received from a peer device, and the like are performed.

Figure 15:
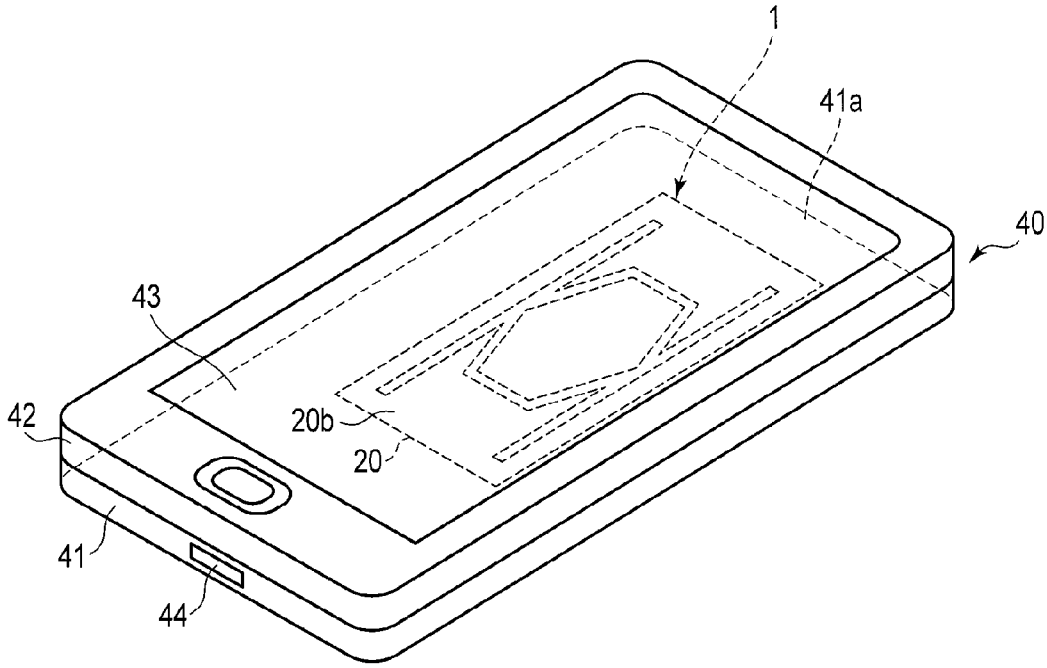
FIG. 15 is an exemplary perspective view illustrating another electronic device to which the antenna according to the embodiment is applied.

FIG. 15 illustrates the example of another electronic device comprising the antenna 1.

The electronic device of FIG. 15 is a mobile device such as the smartphone 40. The smartphone 40 comprises a housing to which the antenna 1 can be attached. The housing comprises a lower housing 41 and an upper housing 42. On the upper surface of the upper housing 42, a display 43 is disposed. On the lower surface of the lower housing 41, a connector 44 such as a micro-USB connector is disposed.

The antenna 1 may be attached on the inner surface of the bottom wall of the lower housing 41. In this case, the first surface 20*a* of the printed circuit board 20 of the antenna 1 may face the inner surface of the bottom wall of the lower housing 41.

The antenna 1, which is thus built in the smartphone 40, allows a user to perform data transfer between devices only by placing the back side of the smartphone 40 above other devices.

The mobile device comprising the antenna 1 is not limited to a smartphone. The mobile device comprising the antenna 1 may be, for example, a PDA, personal computer and tablet.

While FIG. 15 illustrates a case where a housing to which the antenna 1 can be attached is a housing of the smartphone 40 itself, a housing to which the antenna 1 can be attached may be a back cover attachable to the smartphone 40 (mobile device). In the following, a structure where the antenna 1 is attached to the back cover will be described. The back cover functions as a communication device configured to add a close proximity wireless function to a mobile device. In other words, the back cover is a communication device attachable to a mobile device.

Figure 16:
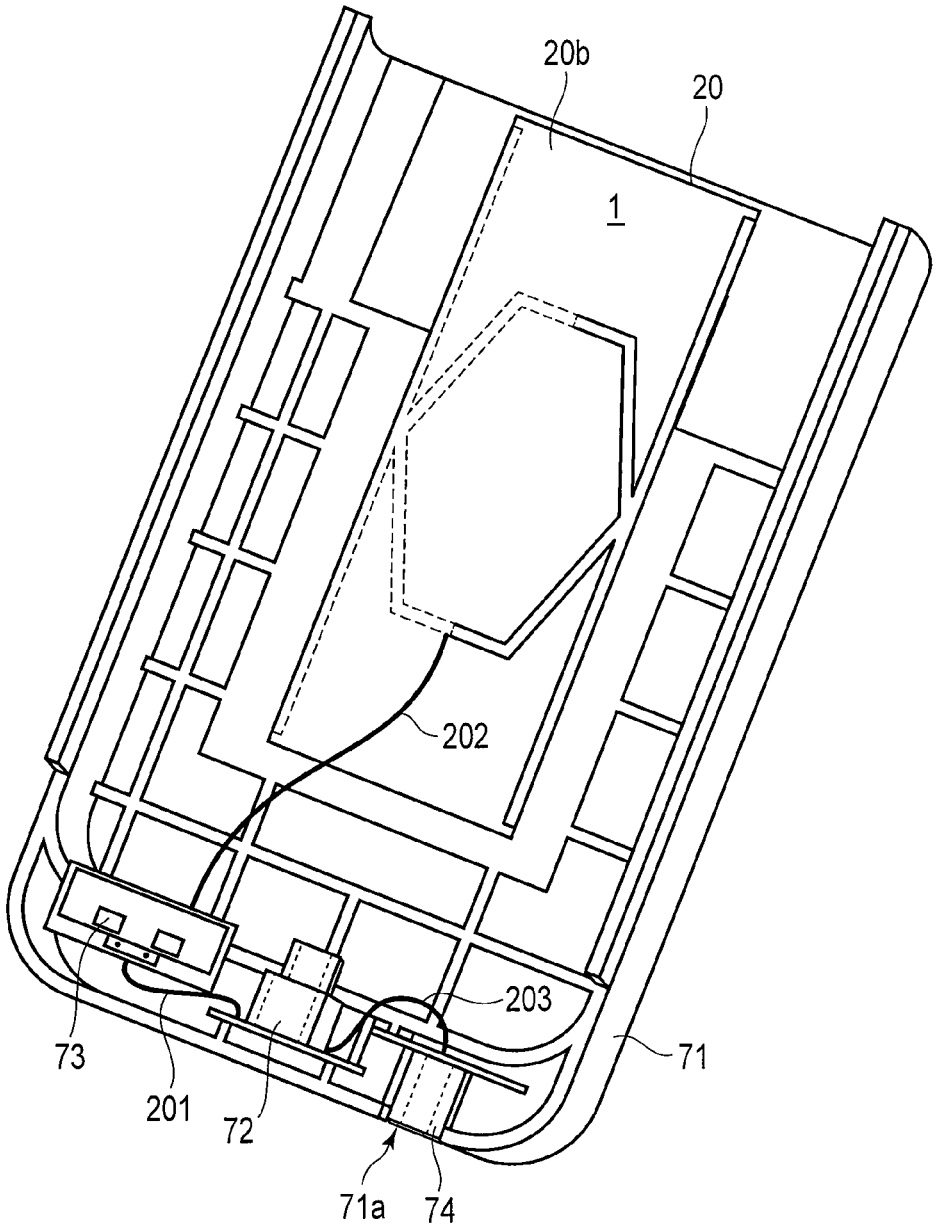
FIG. 16 is an exemplary perspective view illustrating still another electronic device (communication device) to which the antenna according to the embodiment is applied.

FIG. 16 illustrates a bottom case 71, which is the main part of the back cover. On the inner surface of the bottom wall of the bottom case 71, an installation part to which the antenna 1 can be attached is disposed. The installation part may be simply a component mounting space or a member that can support the printed circuit board 20 of the antenna 1.

On the inner surface of the bottom wall of the bottom case 71, an installation part to which a connector 72 can be attached is disposed. The connector 72 is configured to be connected to the connector of the smartphone 40. The installation part may be simply a component mounting space or a member that can support the connector 72.

The connector of the smartphone 40 corresponds to the connector 44 described in FIG. 15. The connector of the smartphone 40 is a connector (female connector), e.g., a micro-USB receptacle, for the peripheral interfaces. The connector of the smartphone 40 is disposed in the housing of the smartphone 40. The connector 72 is a male connector connectable to the above-mentioned connector (female connector) for the peripheral interface, such as a micro-USB plug.

On the inner surface of the bottom wall of the bottom case 71, an installation part to which a close proximity wireless communication module 73 can be attached is disposed. The close proximity wireless communication module 73 is configured to perform close proximity wireless communication by using the antenna 1. The installation part may be simply a component mounting space or a member that can support the printed circuit board of the close proximity wireless communication module 73. The close proximity wireless communication module 73 comprises a radio-frequency circuit (RF circuit) and a host interface, as with the close proximity wireless communication module 52 described in FIG. 14. The host interface may be an interface such as USB.

The close proximity wireless communication module 73 is configured to be connected to the connector 72 via a cable 201. The close proximity wireless communication module 73 is also configured to be connected to the antenna 1 via a cable 202.

When the smartphone 40 is inserted into the bottom case 71, the connector 72 is inserted into the connector of the smartphone 40. The close proximity wireless communication module 73 can be thereby electrically connected to the smartphone 40 and operated by power supplied from the smartphone 40 via an interface such as USB.

When the smartphone 40 is inserted into the bottom case 71, the connector of the smartphone 40 is not exposed outside.

Therefore, an installation part to which a connector 74 for an external interface may be attached is still further disposed on the inner surface of the bottom wall of the bottom case 71. The connector 74 is attached to the installation part so that the end surface of the connector 74 is exposed outside via an opening 71*a* disposed on the lower surface of the bottom case 71. The installation part may be simply a component mounting space or a member that can support the connector 74. The connector 74 is connected to the connector 72 via a cable 203.

A user is allowed to insert an USB cable or the like to the connector 74 without removing the smartphone 40 from the bottom case 71. For example, a circuit configured to automatically select the cable 201 or the cable 203 may be disposed on the printed circuit board, to which the connector 72 is attached.

Figure 17:
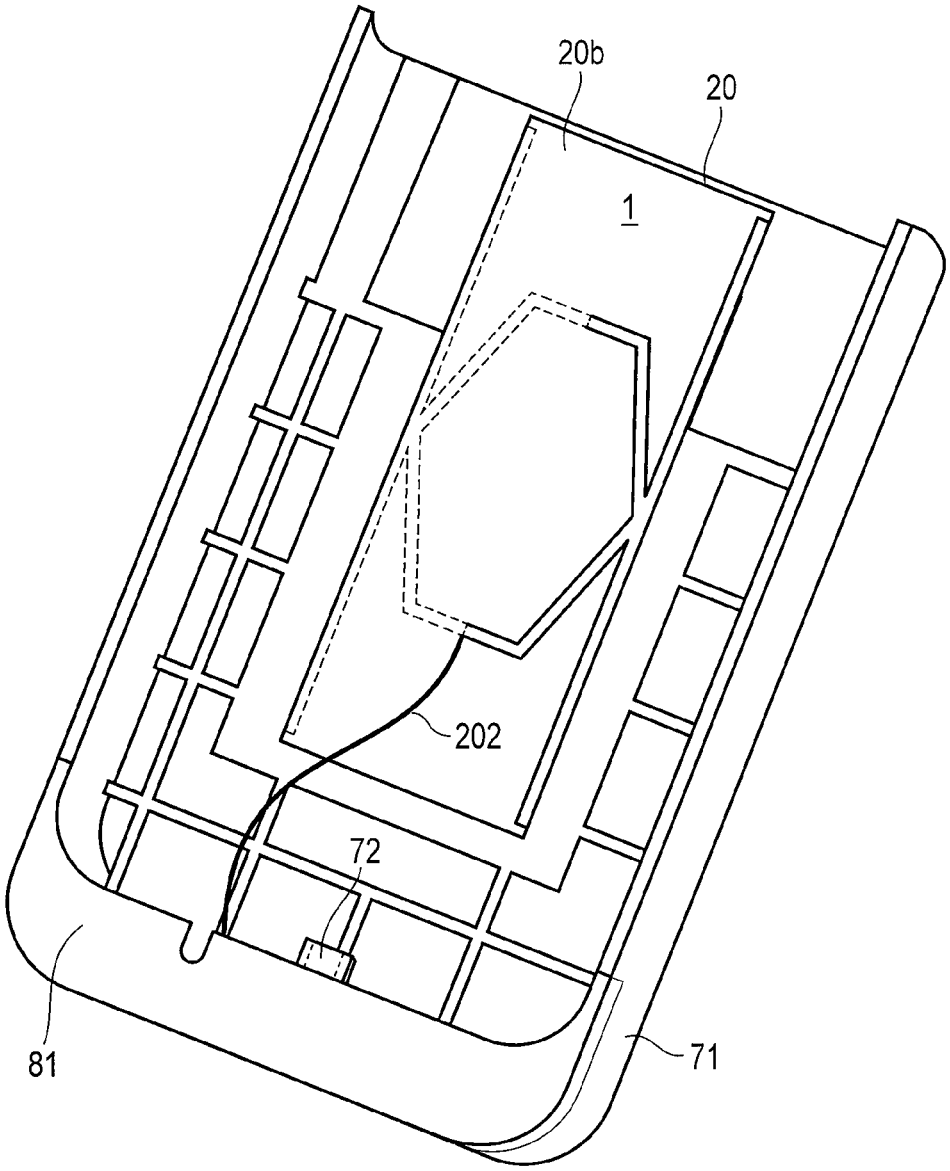
FIG. 17 is an exemplary view illustrating a state where an upper case is attached to the bottom case of the electronic device of FIG. 16.
Figure 18:
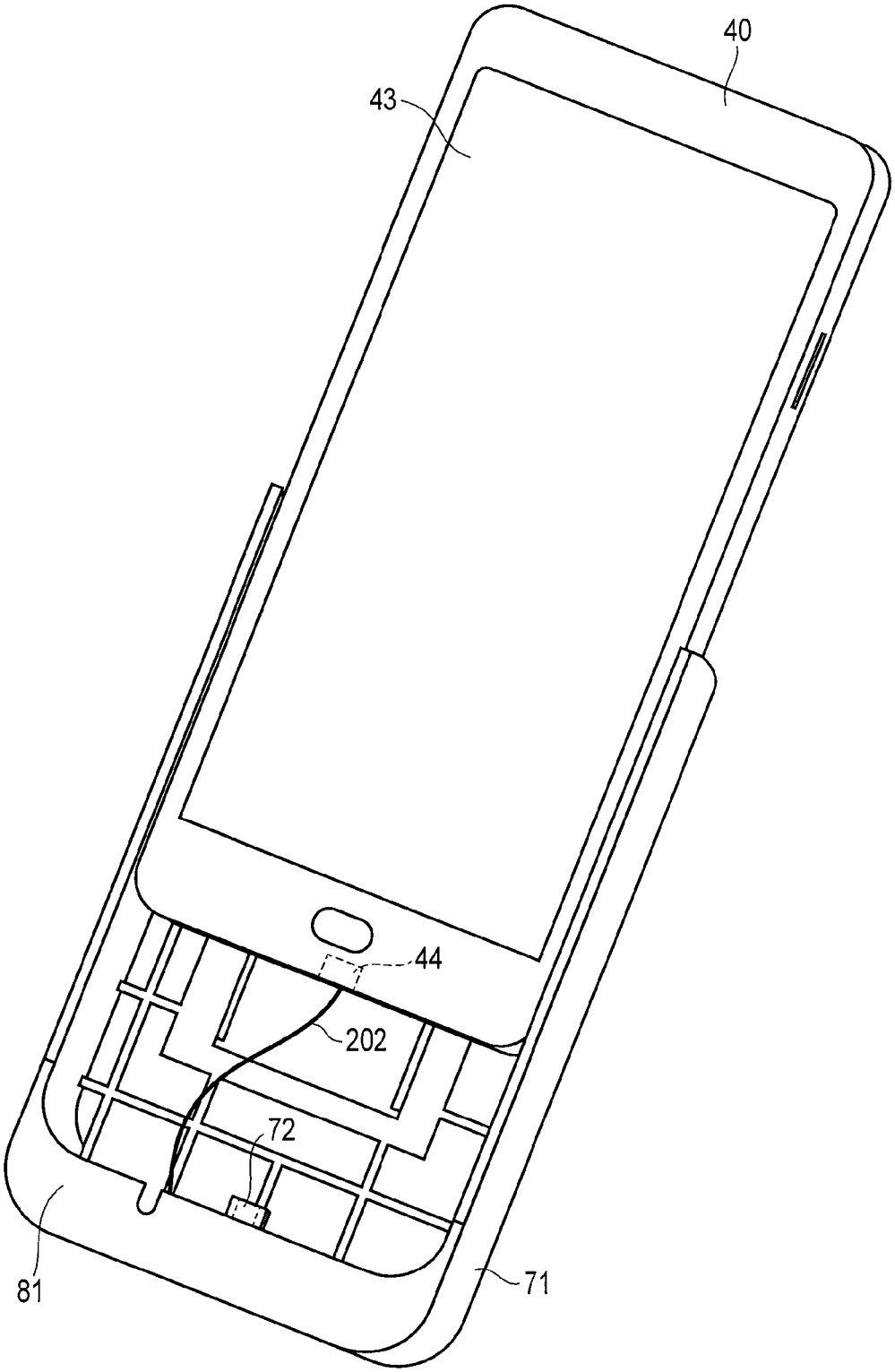
FIG. 18 is an exemplary view illustrating a process of inserting another electronic device (smartphone) into the bottom case of the electronic device of FIG. 16.

FIG. 17 illustrates a state where a top case 81 is attached to the bottom case 71. The top case 81 is a housing portion that can be fitted on the upper surface of the lower portion of the bottom case 71.

Figure 19:
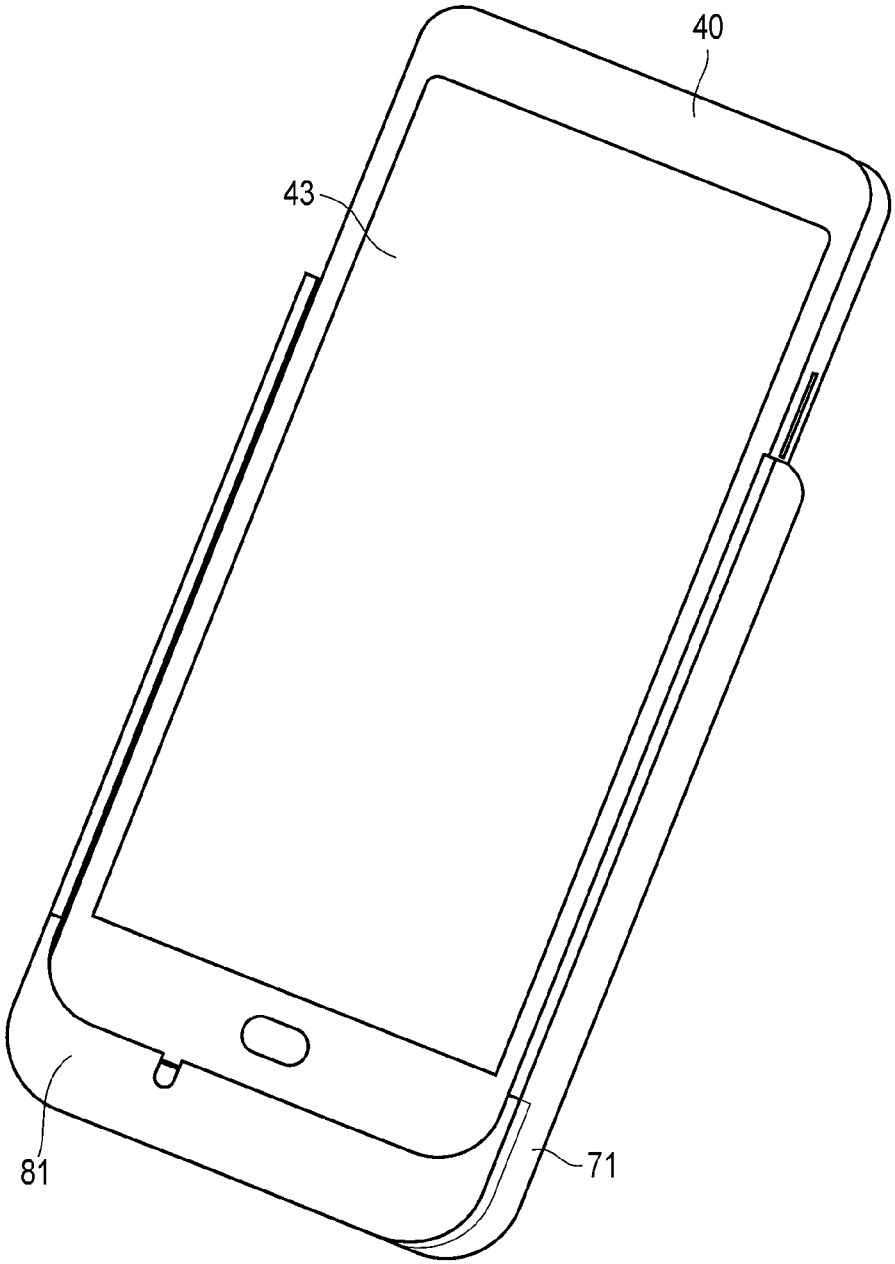
FIG. 19 is an exemplary view illustrating a state where the electronic device (smartphone) is inserted into the bottom case of the electronic device of FIG. 16.

The smartphone 40 is slid downward along both side walls of the bottom case 71 in FIG. 19. Thus, the smartphone 40 is inserted into the bottom case 71 as shown in FIG. 19. In this case, the connector 72 is inserted into the connector of the smartphone 40.

Figure 20:
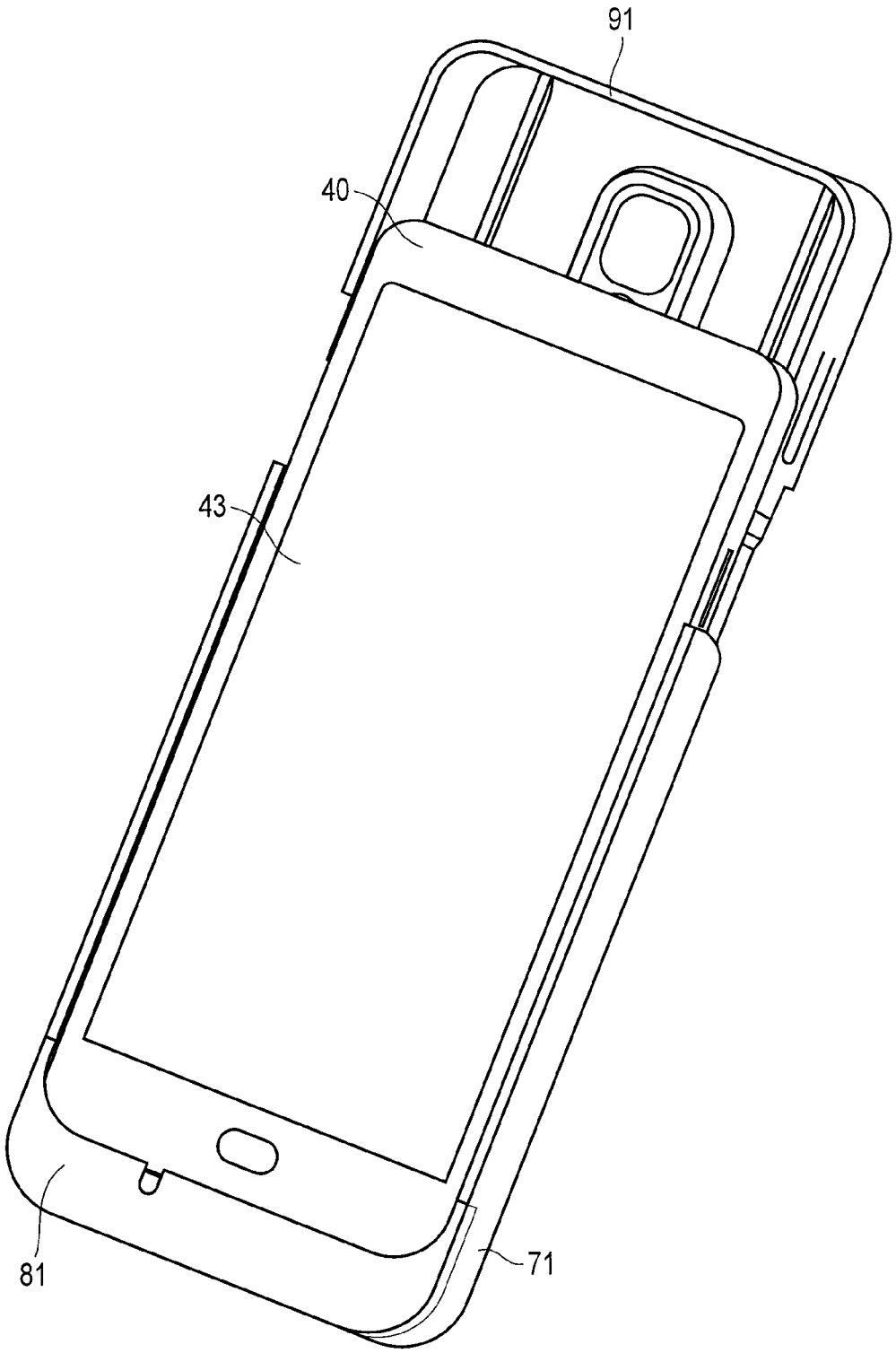
FIG. 20 is an exemplary view illustrating a process of attaching a top case to the bottom case of the electronic device of FIG. 16.
Figure 21:
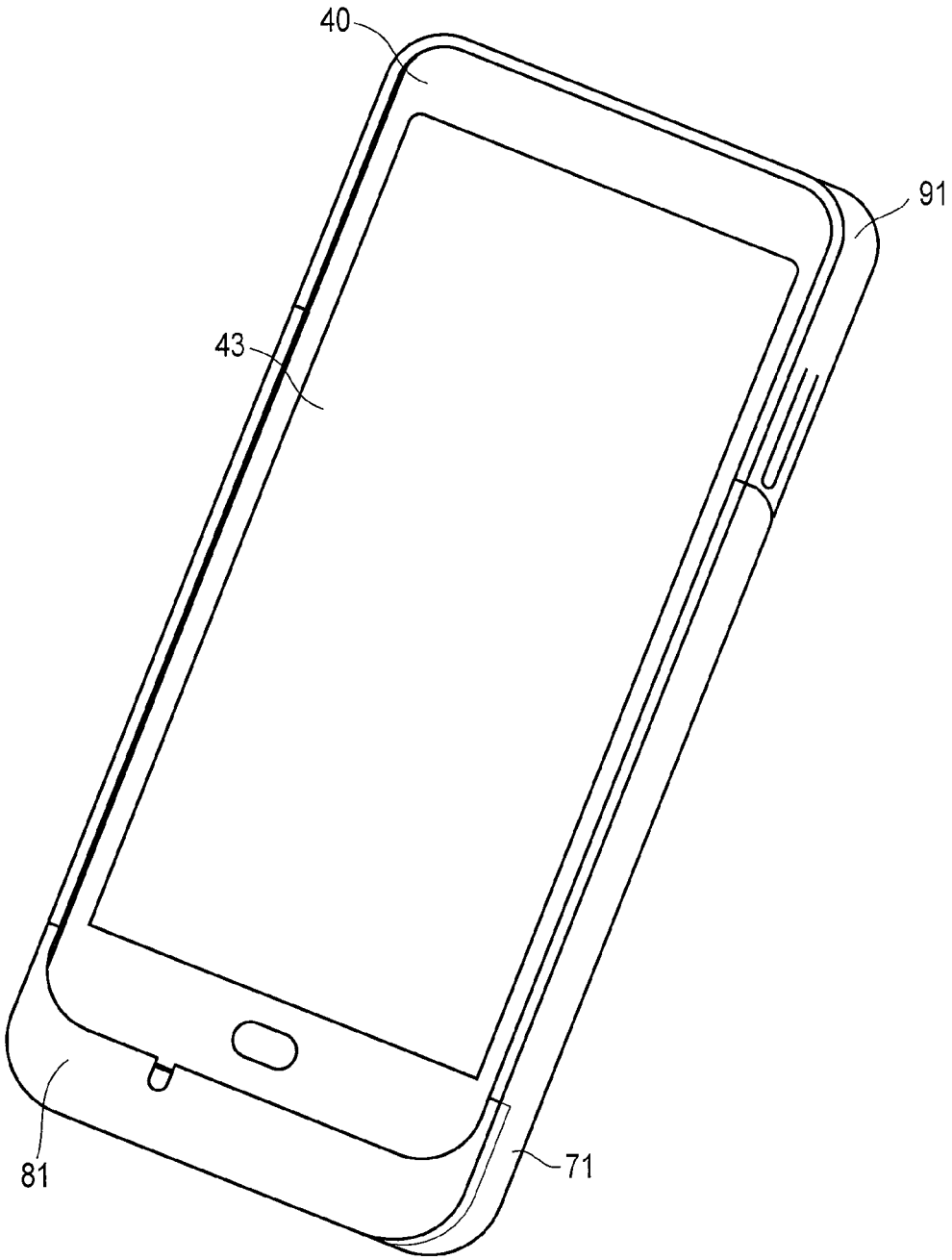
FIG. 21 is an exemplary view illustrating a state where the top case is attached to the bottom case of the electronic device of FIG. 16.

As shown in FIG. 20, a top case 91 can be attached on the upper portion of the back surface of the smartphone 40. The top case 91 is a case to cover the upper portion of the back surface of the smartphone 40. By sliding the top case 91 downward, the top case 91 is fitted into the bottom case 71 as shown in FIG. 21. It is thereby possible to cover the back surface of the housing of the smartphone 40 by a back cover constituted by the bottom case 71, the top case 91 and the top case 81.

While a case has been exemplified above where the housing of the back cover comprises three housing portions of the bottom case 71, the top case 91 and the top case 81, the housing of the back cover may comprise only one housing portion, for example, the bottom case 71. Also, the position of the connector 72 connected to the connector of the smartphone 40 should be set to a position corresponding to the position of the connector of the smartphone 40, not limited on the lower surface of the bottom case 71. Further, while a component such as the antenna 1, the connector 72, the connector 74 and the close proximity wireless module 73 may be attached to the bottom case 71 in advance before the factory shipment of the back cover, it is also possible for a user who buys the back cover to attach to a corresponding installation part in the bottom case 71 each component such as the antenna 1, the connector 72, the connector 74 and the close proximity wireless module 73, which are enclosed in the product package of the back cover.

Figure 22:
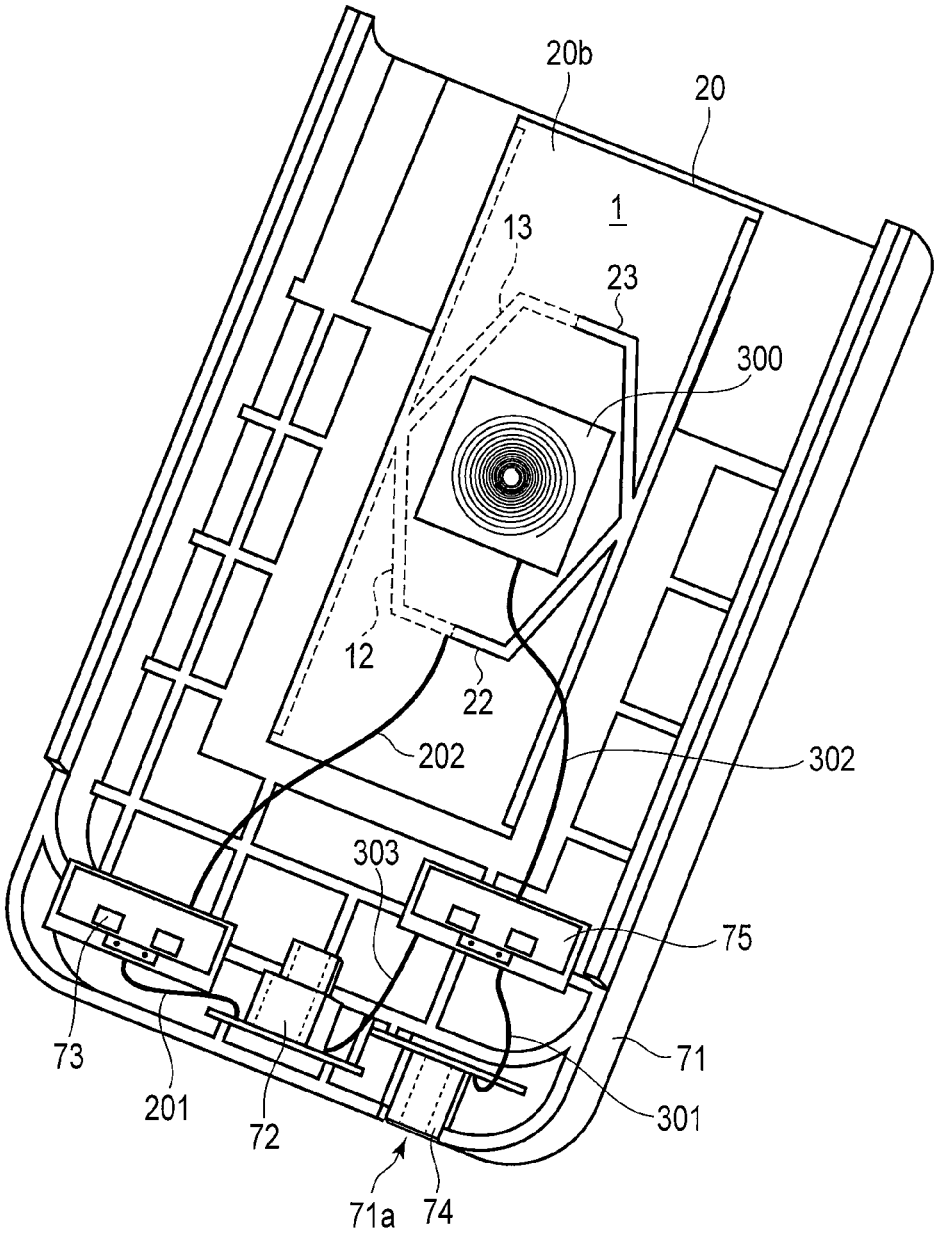
FIG. 22 is an exemplary view illustrating a state where a printed circuit board comprising the antenna according to the embodiment and a wireless charging coil is disposed on the bottom case of the electronic device of FIG. 18.

FIG. 22 illustrates another example of the bottom case 71, which is the main part of the back cover.

As shown in FIG. 22, a wireless charging (inductive charging) coil 300 for supply electricity power to the smartphone 40 via the connector of the smartphone 40 may be disposed on the surface (the second surface 20*b*) of the printed circuit board 20 of the antenna 1. As shown in FIG. 24, the wireless charging coil 300 may also be disposed in the center region of the antenna 1 (a space surrounded by the feeding element 12, the short-circuiting element 13, the feeding element 22 and the short-circuiting element 23).

Also, on the inner surface of the bottom wall of the bottom case 71, an installation part to which a circuit module 75 can be attached may be disposed. The circuit module 75 is configured to supply to the connector 72 power received by the wireless charging coil 300. This installation part may be simply a component mounting space and comprise a member that can support the printed circuit board of the circuit module 75.

The circuit module 75 may comprise a switch configured to select the wireless charging coil 300 or the other component of the connector 74. In this case, the circuit module 75 may be connected to the connector 74 via a cable 301, connected to the wireless charging coil 300 via a cable 302, and connected to the connector 72 via a cable 303.

It is not always necessary that the circuit module 75 comprise the switch part. In this case, the circuit module 75 and the connector 74 may not be connected. Also, the circuit module 75 may be configured to supply power from the wireless charging coil 300 to the connector 72 via the cable 303.

As described above, in the embodiment, the electrical length between the middle point A1 of the first coupling element 11 and each of the open ends E1 and E2 thereof is set to the first electrical length (L1), which is an odd multiple of ¼ of the wavelength λ. Also, the electrical length between the middle point A2 of the second coupling element 21 and each of the open ends E3 and E4 thereof is set to the first electrical length (L1). It is thereby possible that on the upper surface of the antenna 1, a portion along with a longitudinal direction of the first coupling element 11 and a portion along with a longitudinal direction of the second coupling element 21 function as a coupling portion that can be coupled with other antenna.

Further, the electrical length of each of the feeding element 12, the short-circuiting element 13, the feeding element 22 and the short-circuiting element 23 is set to the second electrical length (L2), which is an odd multiple of ¼ of the wavelength λ. It is thereby possible to use as a coupling portion a region (central region) between a portion along with a longitudinal direction of the first coupling element 11 and a portion along with a longitudinal direction of the second coupling element 21. Therefore, since almost the whole region of the upper surface of the antenna 1 can be used as a coupling portion, the antenna 1 and other antenna can be easily coupled.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna comprising:

a first coupling element comprising a first open end and a second open end, the first coupling element extending in a first direction;

a second coupling element comprising a third open end and a fourth open end, the second coupling element facing the first coupling element across a gap and extending parallel to the first coupling element;

a first connecting element connecting a positive-side feed point of a feed terminal and a middle point between the first and second open ends of the first coupling element, the feed terminal positioned between the first coupling element and the second coupling element;

a second connecting element connecting a connecting point positioned between the first coupling element and the second coupling element and the middle point of the first coupling element;

a third connecting element connecting a ground-side feed point of the feed terminal and a middle point between the third and fourth open ends of the second coupling element; and a fourth connecting element connecting the connecting point and the middle point of the second coupling element, wherein an electrical length between the middle point of the first coupling element and each of the first and second open ends is a first electrical length which is an odd multiple of ¼ of a wavelength λ corresponding to a frequency used for close proximity wireless communication;

an electrical length between the middle point of the second coupling element and each of the third and fourth open ends is the first electrical length; and an electrical length of each of the first, second, third and fourth connecting elements is a second electrical length which is an odd multiple of ¼ of the wavelength λ.

2. The antenna of claim 1, wherein the first electrical length is $n \times \lambda/4$;

the second electrical length is $m \times \lambda/4$;

n is an odd number greater than or equal to 3; and m is an odd number greater than or equal to 3.

3. The antenna of claim 1, further comprising a printed circuit board, wherein the first coupling element, the second connecting element and the third connecting element are disposed on a first region on a first surface of the printed circuit board; and the second coupling element, the third connecting element and the fourth connecting element are disposed on a second region on a second surface of the printed circuit board.

4. The antenna of claim 3, wherein the printed circuit board is a rigid printed circuit board or a flexible circuit board.

5. The antenna of claim 1, wherein the feed terminal and the connecting point are positioned on both sides of a virtual line connecting the middle point of the first coupling element and the middle point of the second coupling point.

6. The antenna of claim 1, wherein each of the first, second, third and fourth connecting elements comprises at least an element portion extending along with a second direction, which is orthogonal to the first direction.

7. An electronic device comprising:

a housing to which an antenna is attachable; and a communication module configured to perform close proximity wireless communication by using the antenna, wherein the antenna comprises:

a first coupling element comprising a first open end and a second open end, the first coupling element extending in a first direction;

a second coupling element comprising a third open end and a fourth open end, the second coupling element facing the first coupling element across a gap and extending parallel to the first coupling element;

a first connecting element connecting a positive-side feed point of a feed terminal and a middle point between the first and second open ends of the first coupling element, the feed terminal positioned between the first coupling element and the second coupling element;

a second connecting element connecting a connecting point positioned between the first coupling element and the second coupling element and the middle point of the first coupling element;

a third connecting element connecting a ground-side feed point of the feed terminal and a middle point between the third and fourth open ends; and a fourth connecting element connecting the connecting point and the middle point of the second coupling element, wherein an electrical length between the middle point of the first coupling element and each of the first and second open ends is a first electrical length which is an odd multiple of ¼ of a wavelength λ corresponding to a frequency used for close proximity wireless communication;

an electrical length between the middle point of the second coupling element and each of the third and fourth open ends is the first electrical length; and an electrical length of each of the first, second, third and fourth connecting elements is a second electrical length which is an odd multiple of ¼ of the wavelength λ.

8. The electronic device of claim 7, wherein the first electrical length is $n \times \lambda/4$;

the second electrical length is $m \times \lambda/4$;

n is an odd number greater than or equal to 3; and m is an odd number greater than or equal to 3.

9. The electronic device of claim 7, wherein the electronic device is either a digital terminal configured to provide a service to a mobile device close to the digital terminal by using the close proximity wireless communication, a mobile device, or a communication device attachable to a mobile device.

10. The electronic device of claim 9, wherein the communication device comprises as the housing a back cover attachable to a mobile device, the back cover comprising:

a first installation part to which the antenna is attachable;

a second installation part to which a first connector is attachable, the first connector configured to be connected to a connector of a mobile device; and a third installation part to which the communication module is attachable.

11. An antenna comprising:

first and second coupling elements;

a first connecting element connecting a positive-side feed point and a middle point of the first coupling element;

a second connecting element connecting a connecting point and the middle point of the first coupling element;

a third connecting element connecting a ground-side feed point and a middle point of the second coupling element; and a fourth connecting element connecting the connecting point and the middle point of the second coupling element, wherein an electrical length between the middle point of the first coupling element and each of the first and second open ends is a first electrical length which is an odd multiple of ¼ of a wavelength λ corresponding to a frequency used for close proximity wireless communication;

an electrical length between the middle point of the second coupling element and each of the third and fourth open ends is the first electrical length; and an electrical length of each of the first, second, third and fourth connecting elements is a second electrical length which is an odd multiple of ¼ of the wavelength λ.

* * * * *